US012703941B2

(12) United States Patent
Bae et al.

(10) Patent No.: US 12,703,941 B2
(45) Date of Patent: Aug. 11, 2026

(54) CLOTHING PROCESSING APPARATUS

(71) Applicant: LG Electronics Inc., Seoul (KR)

(72) Inventors: Jaeil Bae, Seoul (KR); Hoil Jeon, Seoul (KR); Youngsoo Ha, Seoul (KR); Kyungah Lee, Seoul (KR); Kyutae Park, Seoul (KR)

(73) Assignee: LG Electronics Inc., Seoul (KR)

( * ) Notice: Subject to any disclaimer, the term of this patent is extended or adjusted under 35 U.S.C. 154(b) by 947 days.

(21) Appl. No.: 17/798,221

(22) PCT Filed: Jan. 29, 2021

(86) PCT No.: PCT/KR2021/001185

§ 371 (c)(1),
(2) Date: Aug. 8, 2022

(87) PCT Pub. No.: WO2021/157961

PCT Pub. Date: Aug. 12, 2021

(65) Prior Publication Data

US 2023/0118347 A1 Apr. 20, 2023

(30) Foreign Application Priority Data

Feb. 7, 2020 (KR) ..... 10-2020-0014961
Feb. 7, 2020 (KR) ..... 10-2020-0014962
Feb. 7, 2020 (KR) ..... 10-2020-0014963

(51) Int. Cl.
*D06F 73/02* (2006.01)
*D06F 75/16* (2006.01)
(Continued)

(52) U.S. Cl.
CPC ..... *D06F 73/02* (2013.01); *D06F 75/16* (2013.01); *D06F 75/20* (2013.01); *D06F 75/28* (2013.01); *D06F 75/38* (2013.01); *D06F 81/00* (2013.01)

(58) Field of Classification Search
CPC ..... D06F 73/02; D06F 75/16; D06F 75/20; D06F 75/28; D06F 75/38; D06F 81/00
(Continued)

(56) References Cited

U.S. PATENT DOCUMENTS 1,940,128 A * 12/1933 Howard ..... D06F 81/06 108/116
2010/0162596 A1 7/2010 Ma et al.
2016/0047083 A1* 2/2016 Yoo ..... D06F 71/32 38/1 A

FOREIGN PATENT DOCUMENTS

CN 101213336 7/2008
CN 204959437 U 1/2016
(Continued)

OTHER PUBLICATIONS

Engilish Translation of KR 10-2013-0066115 (Year: 2013).*
(Continued)

*Primary Examiner* — Connor J Tremarche
(74) *Attorney, Agent, or Firm* — Fish & Richardson P.C.

(57) ABSTRACT

The present application relates to a clothing processing apparatus comprising: a cabinet provided with a first housing and a second housing which provide an accommodation space; an outlet passing through the upper surface of the cabinet and communicating with the second housing; a first support part that can rotate from one surface of the cabinet toward the upper surface of the cabinet, and provides a space in which clothing is supported; a processing part which can be withdrawn from the first housing and provided so as to supply at least one of heat or moisture to the clothing; a body which can be withdrawn from the second housing via the outlet; and a second support part which is provided in the body and located above the first support part, provides a space in which the clothing is supported, and has a smaller area than the first support part. The second support part
(Continued)

includes: a first board which is fixed to the body so as to be capable of rotating from the body toward the upper surface of the first support part; and a second board which is rotatably fixed to the first board so as to be capable of rotating on a plane parallel to the upper surface of the first support part, and which provides a space in which the clothing is supported.

20 Claims, 18 Drawing Sheets

(51) Int. Cl.

| | |
|---|---|
| ***D06F 75/20*** | (2006.01) |
| ***D06F 75/28*** | (2006.01) |
| ***D06F 75/38*** | (2006.01) |
| ***D06F 81/00*** | (2006.01) |

(58) Field of Classification Search
USPC ..... 34/523
See application file for complete search history.

(56) References Cited

FOREIGN PATENT DOCUMENTS

| | | | | | |
|---|---|---|---|---|---|
| CN | 206570587 | U | | 10/2017 | |
| CN | 206858899 | U | | 1/2018 | |
| CN | 207084918 | U | | 3/2018 | |
| CN | 108166230 | A | | 6/2018 | |
| EP | 2920358 | | | 6/2018 | |
| JP | H04-73399 | U | | 6/1992 | |
| JP | H06198099 | | | 7/1994 | |
| JP | 2010-155106 | A | | 7/2010 | |
| KR | 10-1997-0002314 | B1 | | 2/1997 | |
| KR | 10-0424555 | B1 | | 3/2004 | |
| KR | 20-0356584 | Y1 | | 7/2004 | |
| KR | 20-0375291 | Y1 | | 2/2005 | |
| KR | 10-2006- 0059916 | | | 6/2006 | |
| KR | 100744991 | | | 8/2007 | |
| KR | 10-2008-0056833 | A | | 6/2008 | |
| KR | 20-2011-0000207 | U | | 1/2011 | |
| KR | 20130066115 | | | 6/2013 | |
| KR | 20130066115 | A | * | 6/2013 | ..... D06F 71/29 |
| KR | 10-2014-0120054 | A | | 10/2014 | |
| KR | 10-2014- 0120055 | | | 10/2014 | |
| KR | 10-2016-0014795 | A | | 2/2016 | |
| KR | 2016-0064548 | A | | 6/2016 | |
| KR | 10-1927788 | B1 | | 12/2018 | |
| KR | 10-1951231 | B1 | | 2/2019 | |
| KR | 10-2019- 0137441 | | | 12/2019 | |
| WO | WO 2014/076728 | | | 5/2014 | |
| WO | WO-2014076728 | A2 | * | 5/2014 | ..... D06F 81/08 |
| WO | WO 2016/124705 | | | 8/2016 | |

OTHER PUBLICATIONS

International Search Report and Written Opinion in International Appln. No. PCT/KR2021/001185, dated Jun. 1, 2021, 13 pages (with English translation).
Extended European Search Report in European Appln. No. 21750953.8, dated Feb. 7, 2024, 8 pages.
Notice of Allowance in Chinese Appln. No. 202180013007.5, dated Jan. 2, 2024, 8 pages (with English translation).
Office Action in Korean Appln. No. 10-2020-0014962, mailed on Nov. 12, 2024, 4 pages.
Office Action in Korean Appln. No. 10-2020-0014963, mailed on Nov. 12, 2024, 9 pages (with English translation).
Notice of Allowance in Korean Appln. No. 10-2020-0014961, mailed on Apr. 29, 2025, 2 pages (with English translation).
Notice of Allowance in Korean Appln. No. 10-2020-0014962, mailed on Apr. 29, 2025, 2 pages (with English translation).
Notice of Allowance in Korean Appln. No. 10-2020-0014963, mailed on Apr. 29, 2025, 2 pages (with English.translation).
Office Action in Chinese Appln. No. 202410298181.4, mailed on Jun. 12, 2026, 13 pages (official copy only).
Office Action and Search Report in Chinese Appln. No. 202410298189.0, mailed on Jun. 16, 2026, 6 pages (official copy only).

* cited by examiner (b)

(a)

(b)

(a)

(a)

(b)

(b)

(a)

CLOTHING PROCESSING APPARATUS

CROSS-REFERENCE TO RELATED APPLICATIONS

This application is a National Stage application under 35 U.S.C. § 371 of International Application No. PCT/KR2021/001185, filed on Jan. 29, 2021, which claims priority under 35 U.S.C. 119 (a) to Korean Patent Application Nos. 10-2020-0014961, 10-2020-0014962, and 10-2020-0014963, filed on Feb. 7, 2020, respectively. The disclosures of the prior applications are incorporated by reference in their entirety.

TECHNICAL FIELD

The present disclosure relates to a laundry treating apparatus.

BACKGROUND ART

A laundry treating apparatus is a concept including a washing machine that removes foreign substances from laundry using water and detergent, a dryer for drying wet laundry, and an apparatus for removing odors from the laundry or removing wrinkles from the laundry. Among the conventional laundry treating apparatuses, as the apparatus for removing the wrinkles or the odors from the laundry, an apparatus for supplying steam to the laundry hung in an unfolded state in a chamber, and an iron for supplying heat and steam while a user presses the laundry seated on a support surface (an ironing board and the like) were common.

In a case of the laundry treating apparatus such as the iron, because the ironing board on which the laundry is supported is disposed separately from the iron, whenever ironing is required, there was an inconvenience in that the user has to prepare the ironing board and the iron independently.

In addition, in the conventional laundry treating apparatus, a sleeve ironing board necessary for ironing sleeves, shoulders, and the like is not disposed in the ironing board or the laundry treating apparatus, so that the user has to prepare the sleeve ironing board separately.

In addition, the conventional laundry treating apparatus does not have an apparatus for maintaining the unfolded state of the ironing-completed laundry, so that there was an inconvenience that the laundry from which the wrinkles are removed via the ironing wrinkles again.

In addition, the conventional iron was formed to include a heating plate for supplying heat to the laundry. The heating plate disposed in the conventional iron was designed to cut off power supply when a preset temperature is reached so as to prevent the heating plate from being heated to a temperature equal to or higher than a specified temperature. However, even when the temperature of the heating plate is controlled in a temperature range equal to or lower than the certain temperature, damage to the laundry was not able to be avoided when the laundry is remained in contact with the heating plate for a long time.

DISCLOSURE

Technical Problem

The present disclosure is to provide a laundry treating apparatus equipped with treating means for supplying at least one of heat and steam to laundry, and a support for providing a space in which the laundry is supported.

In addition, the present disclosure is to provide a laundry treating apparatus equipped with both an ironing board and a sleeve ironing board so as to provide a laundry treating apparatus that facilitates storage and use of the ironing board and the sleeve ironing board.

In addition, the present disclosure is to provide a laundry treating apparatus capable of hanging laundry whose treatment process such as ironing has been completed in an unfolded state.

In addition, the present disclosure is to provide a laundry treating apparatus equipped with treating means capable of minimizing a risk of damage to laundry caused by a heating plate.

Technical Solutions

The present disclosure relates to a laundry treating apparatus including a cabinet having a first housing and a second housing respectively providing accommodating spaces therein, an outlet extending through a top surface of the cabinet so as to be in communication with the second housing, a first support disposed to be pivotable from one surface of the cabinet toward the top surface of the cabinet so as to provide a space for supporting laundry, treating means withdrawable from the first housing and supplying at least one of heat and moisture to the laundry, and a second support withdrawable from the second housing via the outlet and providing a space for supporting the laundry, and having an area smaller than an area of the support.

The present disclosure relates to a laundry treating apparatus including a cabinet having a first housing and a second housing respectively providing accommodating spaces therein, an outlet extending through a top surface of the cabinet so as to be in communication with the second housing, a first support disposed to be pivotable from one surface of the cabinet toward the top surface of the cabinet so as to provide a space for supporting laundry, treating means withdrawable from the first housing and supplying at least one of heat and moisture to the laundry, a body withdrawn from the second housing via the outlet, and a second support disposed in the body and located above the first support, wherein the second support provides a space for supporting the laundry and has an area smaller than an area of the support.

The second support may include a first board fixed to the body so as to be pivotable from the body toward a top surface of the first support, and a second board pivotably fixed to the first board so as to be pivotable in a plane parallel to the top surface of the first support, and providing the space for supporting the laundry.

The laundry treating apparatus may further include a body withdrawing portion for providing power for the body to be withdrawn from the second housing.

The body withdrawing portion may include a rack disposed in the second housing along a longitudinal direction of the second housing, a pinion rotatably disposed in the body and coupled to the rack, and a pinion motor for rotating the pinion.

The second support may be withdrawable from the body.

The laundry treating apparatus may further include a board accommodating portion defined as a groove having a concavely bent surface directed toward the first support of a space provided by the body so as to provide a space for the second support to be accommodated.

The laundry treating apparatus may further include a clothes hanger support withdrawable from the body and providing a space for a hook of a clothes hanger to be supported.

The clothes hanger support may include a support bar withdrawable from the body, and a hook accommodating portion defined as a groove defined as a surface of the support bar is concavely bent or formed as a protrusion protruding from the surface of the support bar so as to provide a space for the hook of the clothes hanger to be accommodated.

The second support may be defined in a front surface directed in a direction in which the first support is located of the space provided by the body, and the clothes hanger support may be disposed on at least one of a rear surface, a left side surface, a right side surface, and a top surface of the body.

The laundry treating apparatus may further include a steam generator including a storage for providing a space for storing water therein, and a heater for heating water inside the storage, wherein the steam generator is disposed in the first housing, a flow path fastening portion disposed in the body, a connecting tube for connecting the flow path fastening portion and the storage to each other, and a connector having one end connected to the treating means and the other end detachably fixed to the flow path fastening portion so as to supply steam to the treating means.

The treating means may include a heat supply body having a heating plate for dissipating heat when power is supplied disposed on a bottom surface thereof, a handle fixed to the heat supply body, a connecting portion for detachably fixing the handle to the heat supply body, a first flow path defined in the handle and providing a flow path for steam supplied via the connector to move, and a second flow path defined to connect a communication hole defined to extend through the connecting portion and a steam discharge hole defined to extend through the heating plate to each other, wherein the second flow path is connected to the first flow path via the communication hole.

The laundry treating apparatus may further include a cabinet power line disposed in the cabinet and connected to a power supply, a power line fastening portion disposed in the body and connected to the power supply, a power line connecting portion disposed in the connector and detachably coupled to the power line fastening portion, a first power line for supplying power supplied to the power line connecting portion to a first terminal and a second terminal disposed at one end of the handle, a first connecting terminal and a second connecting terminal defined in the connecting portion, and in contact with the first terminal and the second terminal, respectively, when the handle is fixed to the heat supply body, and a second power line for supplying power supplied to the first connecting terminal and the second connecting terminal to the heating plate.

The laundry treating apparatus may further include a connector fixing portion defined in the body to provide therein a space for one end of the connector to be detachably fixed, and the power line fastening portion and the flow path fastening portion may be disposed in the connector fixing portion.

The laundry treating apparatus may further include a power controller disposed on the body and control opening and closing of a circuit for connecting the heater and the cabinet power line to each other.

The laundry treating apparatus may further include water level detecting means for detecting a water level inside the storage, and a display disposed on the body so as to display information transmitted from the water level detecting means.

The laundry treating apparatus may further include a lamp disposed on the body so as to emit light to the first support, and a lamp controller disposed on the body and configured to control operation of the lamp.

The laundry treating apparatus may further include a flow path valve disposed to open and close the first flow path, and a valve controller disposed on the handle and configured to operate the flow path valve.

The laundry treating apparatus may further include a heating plate power controller disposed on the handle and configured to control opening and closing of the first power line.

The laundry treating apparatus may further include water level detecting means for detecting a water level inside the storage, and a handle display disposed on the handle so as to display information detected by the water level detecting means.

The laundry treating apparatus may further include a first through-hole defined in a surface for supporting the laundry of the space provided by the first support, a second through-hole defined in the first support, a fan for moving air from the first through-hole to the second through-hole, and a fan controller disposed on the handle and configured to control at least one of operation of the fan and the number of rotations of the fan.

The present disclosure provides a laundry treating apparatus including a wheel rotatably fixed to a bottom surface of a housing, a support body disposed in the housing to provide a space for laundry to be supported, treating means withdrawable from the housing and supplying at least one of heat and moisture to the laundry, a first frame constructed to accommodate therein one of a front surface and a rear surface of the housing, a left side surface of the housing, and a right side surface of the housing, a first connecting bar formed as a bar having one end fixed to the first frame and the other end located at a point higher than an upper end of the housing, and detachably fixed to one of the left side surface and the right side surface of the housing, a second connecting bar formed as a bar having one end fixed to the first frame and the other end located at a point higher than the upper end of the housing, and detachably fixed to the other of the left side surface and the right side surface of the housing bar, and a support bar constructed to connect the other end of the first connecting bar and the other end of the second connecting bar to each other, and providing a space that a user may grip by hand and a space for a hook of a clothes hanger to be supported.

The present disclosure provides a laundry treating apparatus including a housing having a chamber and a door for opening and closing the chamber, a wheel rotatably fixed to a bottom surface of a housing, a support body disposed in the housing to provide a space for laundry to be supported, treating means withdrawable from the chamber and supplying at least one of heat and moisture to the laundry, a first frame constructed to accommodate therein one of a front surface and a rear surface of the housing, a left side surface of the housing, and a right side surface of the housing, a first connecting bar formed as a bar having one end fixed to the first frame and the other end located at a point higher than an upper end of the housing, and detachably fixed to one of the left side surface and the right side surface of the housing, a second connecting bar formed as a bar having one end fixed to the first frame and the other end located at a point higher than the upper end of the housing, and detachably fixed to the other of the left side surface and the right side surface of the housing bar, and a support bar constructed to connect the other end of the first connecting bar and the other end of the second connecting bar to each other, and providing a space that a user may grip by hand and a space for a hook of a clothes hanger to be supported.

The laundry treating apparatus may further include a hook accommodating portion defined as a groove in which a surface of the support bar is concavely bent to provide a space in which the hook of the clothes hanger is accommodated.

The laundry treating apparatus may include a hook accommodating portion formed as at least two protrusions protruding from the support bar to define a space in which the hook of the clothes hanger is accommodated.

The first frame may include a frame body in contact with one of the front and rear surfaces of the housing, a first bent portion disposed at one end of the frame body and in contact with one of the left side surface and the right side surface of the housing, and a second bent portion disposed at the other end of the frame body and in contact with the other of the left side surface and the right side surface of the housing.

The laundry treating apparatus may include a first mounting groove defined in one of the left side surface and the right side surface of the housing, a first fastening groove defined in the first mounting groove, a first detachable body disposed inside the first connection bar, a first fastening protrusion disposed to extend through the first connection bar, fixed to the first detachable body, and coupled to the first fastening groove, a first transfer protrusion disposed to extend through the first connection bar and fixed to the first detachable body, and when an external force is input, moves the first detachable body in a direction in which the first fastening protrusion is separated from the first fastening groove, and a first pressing portion for pressing the first detachable body in a direction in which the first fastening protrusion is coupled to the first fastening groove.

The laundry treating apparatus may include a second mounting groove defined in the other of the left side surface and the right side surface of the housing, a second fastening groove defined in the second mounting groove, a second detachable body disposed inside the second connection bar, a second fastening protrusion disposed to extend through the second connecting bar, fixed to the second detachable body, and coupled to the second fastening groove, a second transfer protrusion disposed to extend through the second connection bar and fixed to the second detachable body, and when an external force is input, moves the second detachable body in a direction in which the second fastening protrusion is separated from the second fastening groove, and a second pressing portion for pressing the second detachable body in a direction in which the second fastening protrusion is coupled to the second fastening groove.

The laundry treating apparatus may further include a fixing portion for restricting the rotation of the wheel or separating the wheel from the ground to fix the position of the housing.

The fixing portion may include a fixing body positioned between the bottom surface of the housing and the ground, a body pivoting shaft having one end fixed to the fixing body and the other end pivotably fixed to the bottom surface of the housing so as to adjust a gap between the fixing body and the bottom surface of the housing, and a fixing body driver for pivoting the body pivoting shaft.

The fixing body driver may provide power causing the fixing body to reciprocate between the bottom surface of the housing and a point for separating the wheel from the ground to the body pivoting shaft.

The fixing body driver may provide power causing the fixing body to reciprocate between the bottom surface of the housing and a point in contact with the ground to the body pivoting shaft.

The laundry treating apparatus may further include an insertion hole defined in the bottom surface of the housing, a base inserted into the housing through the insertion hole and to which the wheel is fixed, a vertical level adjusting assembly for adjusting a vertical level of the housing, and a fixing portion for restricting the rotation of the wheel or separating the wheel from the ground to fix the position of the base.

The laundry treating apparatus may further include a support accommodating groove defined as a groove in which one of the front surface and the rear surface of the housing is bent concavely, and providing a space in which the support is accommodated, a first pivoting shaft for causing the support to pivot in a plane parallel to the top surface of the housing, a shaft support to which the first pivoting shaft is pivotably fixed, and a second pivoting shaft for pivotably fixing the shaft support to the housing such that the support may pivot from the support accommodating groove to the plane parallel to the top surface of the housing.

The laundry treating apparatus may further include a seating portion disposed on the top surface of the housing to maintain a gap between the support and the top surface of the housing.

The laundry treating apparatus may further include a first shaft driver for pivoting the first pivoting shaft, a second shaft driver for pivoting the second pivoting shaft, driver first operating means disposed on the top surface of the housing to sequentially operate the second shaft driver and the first shaft driver, and driver second operating means disposed on the support to sequentially operate the first shaft driver and the second shaft driver.

The driver second operating means may be disposed on a surface directed in a direction in which the driver first operating means is located of the space provided by the support.

The treating means may include a heat supply body having a heating plate that dissipates heat when power is supplied disposed on a bottom surface thereof, a handle fixed to the heat supply body, heating plate through-holes defined to extend through the heating plate, withdrawable bodies respectively withdrawable from the heating plate through-holes, and actuators for generating power for free ends of the withdrawable bodies to move between first points located inside the heating plate through-holes and second points located outside the heating plate through-holes.

The laundry treating apparatus may further include contact sensing means for sensing whether a user's body and the handle are in contact with each other, and the actuators may move the free ends of the withdrawable bodies to the second points when a duration the user's body is separated from the handle is longer than a preset first reference duration and move the free ends of the withdrawable bodies to the first points when the user's body is in contact with the handle.

The laundry treating apparatus may include a steam generator including a storage for providing a space for storing water therein, and a heater for heating water inside the storage, wherein the steam generator is disposed in the chamber, a connecting portion for detachably fixing the handle to the heat supply body, a first flow path defined in the handle to provide a flow path through which steam moves, a second flow path defined to connect a communication hole defined to extend through the connecting portion and a steam discharge hole defined to extend through the heating plate to each other, and connected to the first flow path via the communication hole, and a connector having a flow path connecting portion for guiding steam discharged from the steam generator to the first flow path.

The laundry treating apparatus may further include a body power line disposed in the housing to supply power to the heater, a first power line disposed to supply power to a first terminal and a second terminal disposed at one end of the handle, a first connecting terminal and a second connecting terminal disposed in the connecting portion and respectively in contact with the first terminal and the second terminal when the handle is fixed to the heat supply body, a second power line for supplying power supplied to the first connecting terminal and the second connecting terminal to the heating plate, and a power line connecting portion disposed in the connector to connect the body power line and the first power line to each other.

The laundry treating apparatus may include a connector first fixing portion defined in the housing and to which one end of the connector is fixed, a connector second fixing portion defined in the handle and to which the other end of the connector is fixed, a discharge port constructed to discharge steam inside the storage, located in the connector first fixing portion, and detachably coupled to the flow path connecting portion, and a power terminal connected to the body power line, located in the connector first fixing portion, and detachably coupled to the power line connecting portion.

The present disclosure may provide a laundry treating apparatus including a heat supply body having a heating plate that dissipates heat when power is supplied disposed on a bottom surface thereof, a handle fixed to the heat supply body, heating plate through-holes defined to extend through the heating plate, withdrawable bodies respectively withdrawable from the heating plate through-holes, and actuators for generating power for free ends of the withdrawable bodies to move between first points located inside the heating plate through-holes and second points located outside the heating plate through-holes.

The laundry treating apparatus may further include contact sensing means for sensing whether a user's body and the handle are in contact with each other, and the actuators may move the free ends of the withdrawable bodies to the second points when a duration the user's body is separated from the handle is longer than a preset first reference duration.

The actuators may move the free ends of the withdrawable bodies to the first points when the user's body is in contact with the handle.

The laundry treating apparatus may further include position detecting means for detecting a movement of the heat supply body, and the actuators may move the free ends of the withdrawable bodies to the second points when a change in the position of the heat supply body is not detected for a preset second reference duration.

The first reference duration and the second reference duration may be set as the same duration.

The heating plate through-holes may include a first through-hole and a second through-hole respectively defined at front and rear sides of the heating plate or at left and right sides of the heating plate, and the withdrawable bodies may include a first withdrawable body withdrawable from the first through-hole and a second withdrawable body withdrawable from the second through-hole.

The laundry treating apparatus may further include a housing having a chamber for providing a space in which the heat supply body and the handle are accommodated, and a door for opening and closing the chamber, a steam generator including a storage for providing a space for storing water therein, and a heater for heating water inside the storage, wherein the steam generator is disposed in the chamber, a support body disposed in the housing to provide a space in which laundry is supported, a connecting portion for detachably fixing the handle to the heat supply body, a first flow path defined in the handle to provide a flow path through which steam moves, a second flow path defined to connect a communication hole defined to extend through the connecting portion and a steam discharge hole defined to extend through the heating plate to each other, and connected to the first flow path via the communication hole, and a connector having a flow path connecting portion for guiding steam discharged from the steam generator to the first flow path.

The connecting portion may include a first connecting body fixed to the heat supply body to be pivotable via a connecting body first shaft, a connecting body first through-hole defined to extend through the first connecting body, and a second connecting body located inside the connecting body first through-hole, fixed to the first connecting body to be pivotable via a connecting body second shaft, and having the communication hole defined therein.

The connecting body first shaft and the connecting body second shaft may be orthogonal to each other.

The laundry treating apparatus may further include a body power line disposed in the housing to supply power to the heater, a first power line disposed in the handle and supplying power to a first terminal and a second terminal disposed at one end of the handle, a first connecting terminal and a second connecting terminal disposed in the second connecting portion and respectively in contact with the first terminal and the second terminal when the handle is fixed to the heat supply body, a second power line for supplying power supplied to the first connecting terminal and the second connecting terminal to the heating plate, and a power line connecting portion disposed in the connector to connect the body power line and the first power line to each other.

The laundry treating apparatus may further include a body power line disposed in the housing to supply power to the heater, a first power line supplying power to a first terminal and a second terminal disposed at one end of the handle, a first connecting terminal and a second connecting terminal disposed in the connecting portion and respectively in contact with the first terminal and the second terminal when the handle is fixed to the heat supply body, a second power line for supplying power supplied to the first connecting terminal and the second connecting terminal to the heating plate, and a power line connecting portion disposed in the connector to connect the body power line and the first power line to each other.

The laundry treating apparatus may include a connector first fixing portion defined in the housing and to which one end of the connector is fixed, a connector second fixing portion defined in the handle and to which the other end of the connector is fixed, a discharge port constructed to discharge steam inside the storage, located in the connector first fixing portion, and detachably coupled to the flow path connecting portion, and a power terminal connected to the body power line, located in the connector first fixing portion, and detachably coupled to the power line connecting portion.

The laundry treating apparatus may further include a flow path valve disposed to open and close the first flow path, and a valve controller disposed on the handle and configured to operate the flow path valve.

The laundry treating apparatus may further include a power controller disposed on the handle and control opening and closing of the first power line.

The laundry treating apparatus may further include a switch for supplying power to the first terminal and the second terminal when the first power line is closed, and cutting off power supply to the first terminal and the second terminal when the first power line is opened, and a power controller disposed on the handle to operate the switch.

The laundry treating apparatus may further include water level detecting means for detecting a water level inside the storage, and a display disposed on the handle so as to display information detected by the water level detecting means.

The laundry treating apparatus may further include a first through-hole defined in a surface for supporting the laundry of the space provided by the support body, a second through-hole defined in the support body, a fan for moving air from the first through-hole to the second through-hole, and a fan controller disposed on the handle and configured to control at least one of operation of the fan and the number of rotations of the fan.

The laundry treating apparatus may further include a brushing unit mounting portion disposed at one end of the handle, a flow path connecting hole defined to extend through the brushing unit mounting portion and connecting the first flow path and the second flow path to each other, a brushing unit having a unit body, a unit body through-hole defined to extend through the unit body and into which the brushing unit mounting portion is inserted, and a brush protruding from the unit body, and a brushing unit accommodating groove defined as a groove in which one surface of the handle is concavely bent to provide a space for accommodating the unit body and the brush, and having a ring shape surrounding the brushing unit mounting portion.

Advantageous Effects

The present disclosure provides the laundry treating apparatus equipped with the treating means for supplying at least one of heat and steam to the laundry, and the support for providing the space in which the laundry is supported.

In addition, the present disclosure provides the laundry treating apparatus equipped with both the ironing board and the sleeve ironing board so as to provide the laundry treating apparatus that facilitates the storage and the use of the ironing board and the sleeve ironing board.

In addition, the present disclosure provides the laundry treating apparatus capable of hanging the laundry whose treatment process such as the ironing has been completed in the unfolded state.

In addition, the present disclosure provides the laundry treating apparatus equipped with the treating means capable of minimizing the risk of the damage to the laundry caused by the heating plate.

BEST MODE

Figure 1:
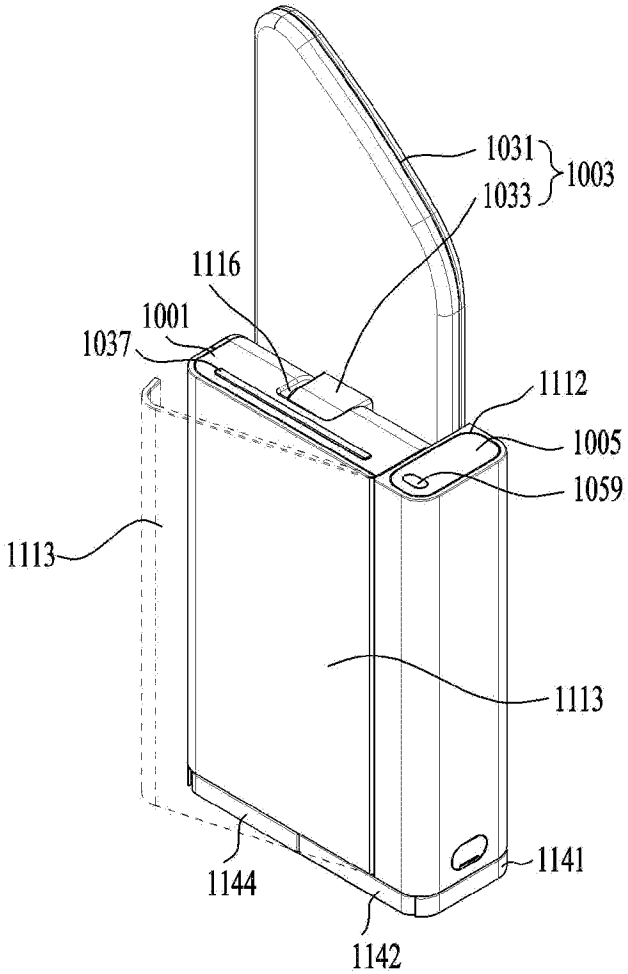
FIGS. 1 and 2 show an example of a laundry treating apparatus.
Figure 1:
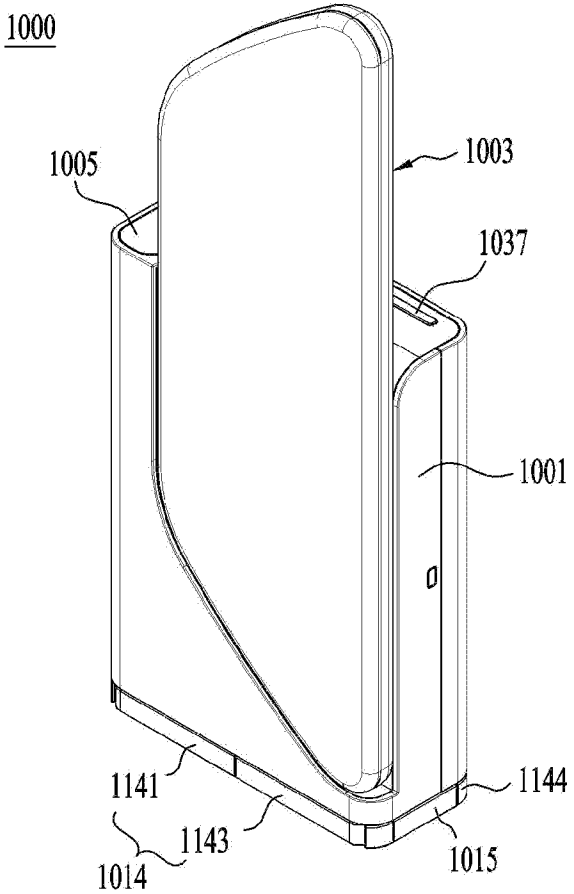

Hereinafter, a preferred embodiment of a laundry treating apparatus will be described in detail with reference to the accompanying drawings. A configuration or a control method of the apparatus to be described below is only for illustrating an embodiment of the laundry treating apparatus, and is not intended to limit the scope of the present disclosure. The same reference numerals used throughout the specification indicate the same components.

As shown in FIG. 1, a laundry treating apparatus 1000 includes a cabinet 1001 that forms an outer appearance of the apparatus, a first support 1003 formed to be pivotable from one surface of the cabinet 1001 toward a top surface of the cabinet 1001 so as to provide a space in which laundry is supported, treating means 1007 that is formed to be extended from the cabinet 1001 so as to supply at least one of heat and moisture to the laundry, and a utility unit 1005 that is formed to be extended from the cabinet 1001 and has an apparatus for providing convenience such as a space in which a clothes hanger is supported.

Figure 2:
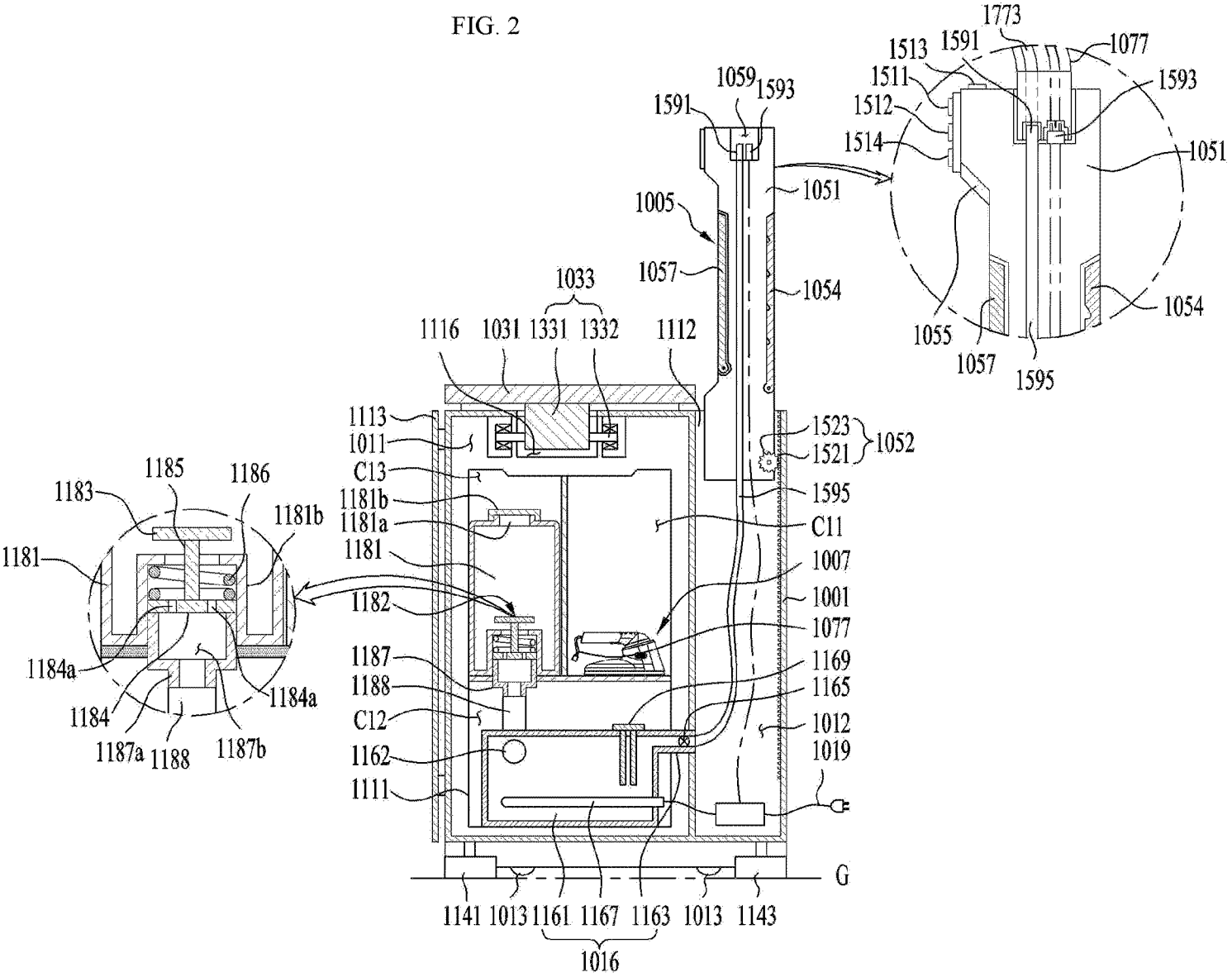

As shown in FIG. 2, a housing for providing an accommodating space is disposed inside the cabinet 1001. The housing may have a first housing 1011 and a second housing 1012 separated from each other via a partition wall dividing the housing into two spaces.

The first housing 1011 may have a first chamber C11 for providing a space in which the treating means 1007 is accommodated, a second chamber C12 in which a steam generator 1016 for supplying steam to the treating means 1007 is accommodated, and a third chamber C13 in which a water supply tank 1018 for supplying water to the steam generator 1016 is accommodated. The second housing 1012 is disposed to provide a space in which the utility unit 1005 is accommodated.

One surface of the cabinet 1001 has an inlet 1111 in communication with the first housing 1011, and the other surface of the cabinet 1001 has an outlet 1112 in communication with the second housing 1012. FIG. 2 illustrates a case in which the inlet 1111 is defined in a front or rear surface of the cabinet 1001 and the outlet 1112 is defined in the top surface of the cabinet 1001 as an example.

The inlet 1111 is opened or closed by a door 1113 pivotably disposed on the cabinet 1001. Accordingly, a user may open the inlet 1111 and then withdraw the apparatuses accommodated in the chambers C11, C12, and C13 to the outside of the cabinet 1001. The utility unit 1005 is withdrawn out of the cabinet 1001 from the second housing 1012 through the outlet 1112.

The steam generator 1016 disposed in the second chamber C12 is constructed to include a storage 1161 that provides a space in which water is stored, and a heater 1167 that is disposed inside the storage and heats water when power is supplied.

The storage 1161 is supplied with water through an inlet hole 1162 connected to the water supply tank 1018, and steam inside the storage is discharged to the outside of the storage 1161 through a discharge port 1163. When a valve 1165 is disposed in the discharge port 1163, steam will be discharged to the outside of the storage 1161 when the valve 1165 opens the discharge port 1163. The storage 1161 may further include water level detecting means 1169 for detecting a water level. The heater 1167 may receive power through a cabinet power line 1019 connected to a power supply.

The water supply tank 1018 may be constructed to include a tank body 1181 that provides therein a space for storing water and is detachably fixed in the third chamber C13, a water discharge valve 1182 disposed on a bottom surface of the tank body 1181, a valve actuator 1187 fixed to a bottom surface of the third chamber C13 so as to open the water discharge valve 1182, and a water supply pipe 1188 having one end connected to the valve actuator 1187 and the other end connected to the inlet hole 1162 of the steam generator.

A water supply port 1181*a* is disposed on a top surface of the tank body 1181. The water supply port 1181*a* is closed by a lid 1181*b* detachably coupled to the tank body 1181. A drain hole 1181*c* that is opened or closed by the water discharge valve 1182 is disposed on the bottom surface of the tank body 1181.

A fastening portion 1181*d* into which the valve actuator 1187 is inserted may be disposed on the bottom surface of the tank body 1181. In this case, the drain hole 1181*c* may be constructed to discharge water inside the tank body 1181 to the fastening portion 1181*d*.

The water discharge valve 1182 may include a first valve body 1183 disposed in the tank body 1181 to close the drain hole 1181*c*, a second valve body 1184 located in the fastening portion 1181*d*, a connecting bar 1185 inserted into the drain hole 1181*c* to connect the first valve body and the second valve body to each other, and a valve body through-hole 1184*a* defined in the second valve body. The fastening portion 1181*d* has a spring 1186 for maintaining the state in which the first valve body 1183 closes the drain hole 1181*c*.

The valve actuator 1187 may include an actuator body 1187*a* fixed to the bottom surface of the third chamber C13, and a body through-hole 1187*b* defined to pass through the actuator body. When the user inserts the tank body 1181 into the third chamber C13, the actuator body 1187*a* is inserted into the fastening portion 1181*d*. When the actuator body 1187*a* is inserted into the fastening portion 1181*d*, the water discharge valve 1182 will open the drain hole 1181*c*, and when the drain hole 1181*c* is opened, water of the tank body will be supplied to the steam generator 1016 through the water supply pipe 1188.

On the bottom surface of the cabinet 1001, a wheel 1013 that facilitates a movement of the cabinet 1001, and a fixing portion 1014 for fixing the cabinet 1001 to a floor surface (a ground) G of an indoor space may be disposed.

Figure 3:
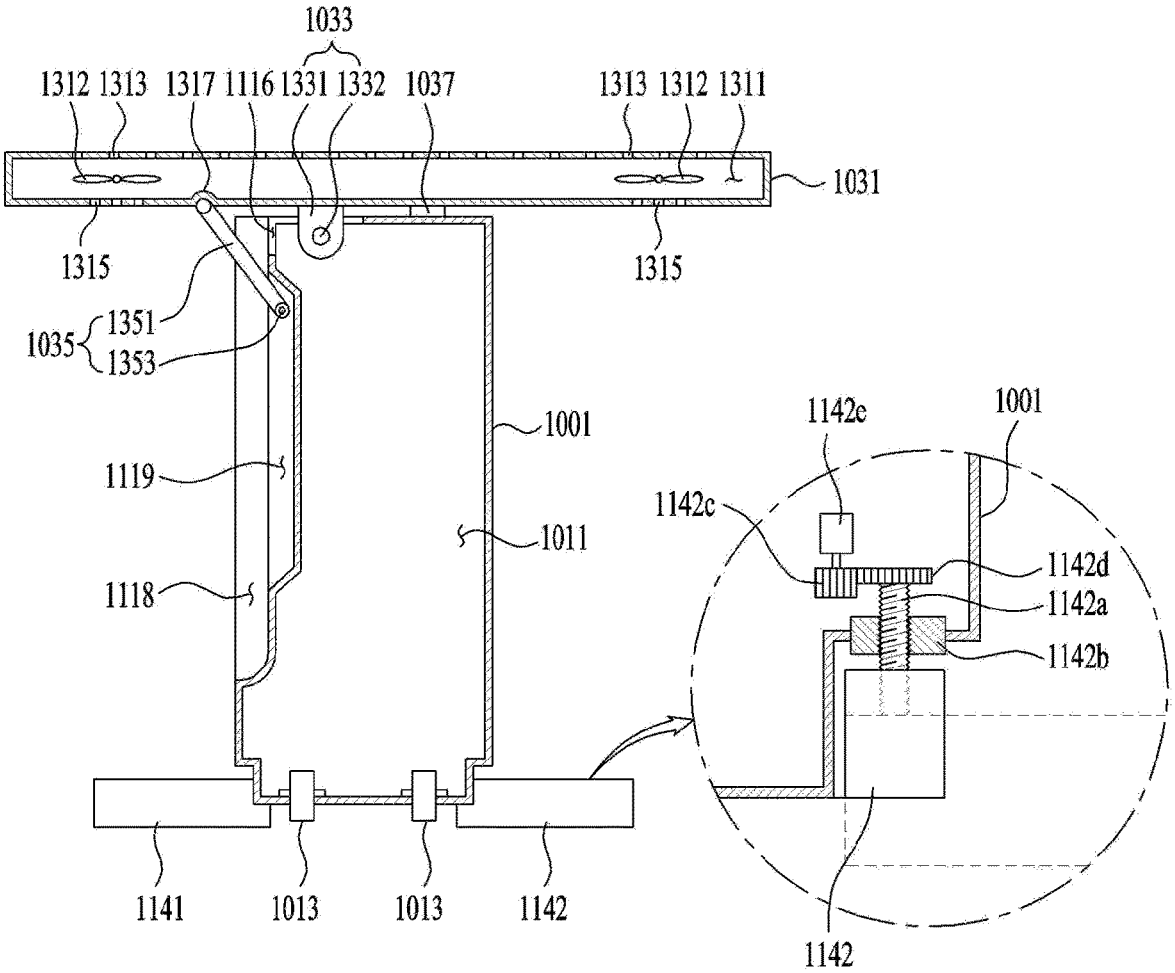
FIGS. 3 and 4 show an operation example of a first support.
Figure 4:
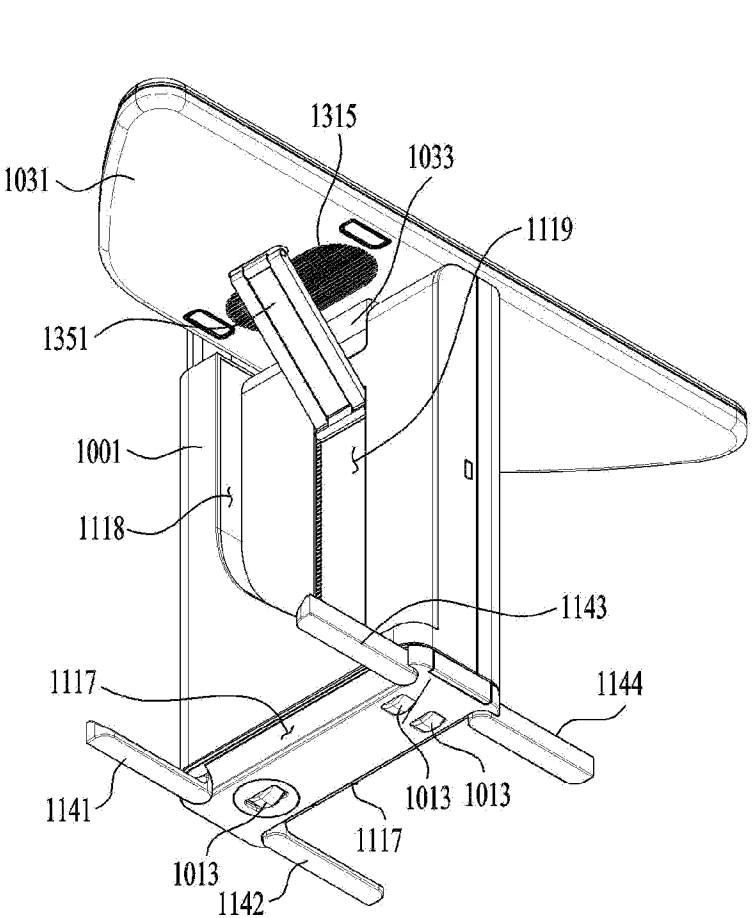
Figure 4:
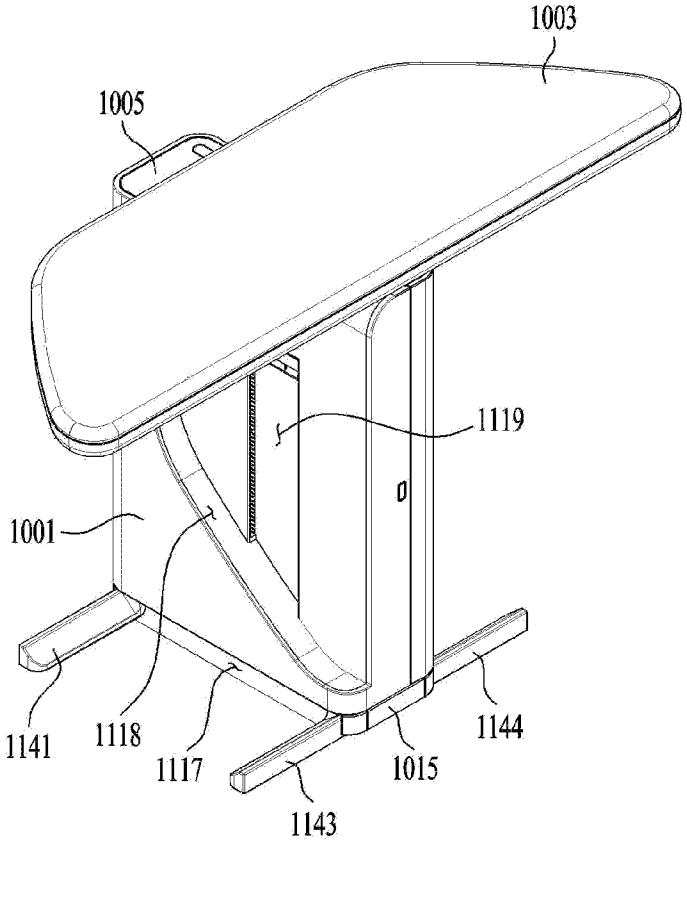

The fixing portion 1014 may be formed in any shape as long as it is able to fix the cabinet 1001 to the ground. The fixing portion 1014 may be composed of two fixing bodies 1141 and 1142 respectively disposed on opposite sides of the bottom surface of the cabinet 1001 as shown in FIG. 3, and may be composed of four fixing bodies 1141, 1142, 1143, and 1144, two of which are disposed on one side of the bottom surface of the cabinet as shown in FIG. 4.

The fixing bodies 1141, 1142, 1143, and 1144 may be pivotably coupled to the bottom surface of the cabinet so as to be unfolded in a direction away from the cabinet as necessary.

Furthermore, the fixing bodies 1141, 1142, 1143, and 1144 may be automatically unfolded via a fixing body driver. As shown in FIG. 3, the fixing body driver may include a shaft support 1142*b* fixed to the bottom surface of the cabinet, a shaft 1142*a* having one end rotatably coupled to the shaft support 1142*b* and the other end fixed to the fixing body, a motor 1142*e* disposed inside the cabinet 1001, a main gear 1142*c* rotated by the motor, and a driven gear 1142*d* disposed on the shaft 1142*a* and fastened to the main driven gear 1142*d*.

Because the shaft 1142*a* is helically coupled to the shaft support 1142*b*, when the shafts 1142*a* are rotated by the motor 1142*e*, the fixing bodies 1141, 1142, 1143, and 1144 will move from the bottom surface of the cabinet 1001 toward the ground G. A distance at which the fixing bodies 1141, 1142, 1143, and 1144 move toward the ground G is preferably set to a distance that separates the wheel 1013 from the ground G.

As shown in FIG. 4, the cabinet 1001 may have fixing portion accommodating grooves 1117 that provides therein a space in which the fixing bodies 1141, 1142, 1143, and 1144 are accommodated. A depth of the fixing portion accommodating groove 1117 may be set to a depth at which surfaces exposed when the fixing bodies 1141, 1142, 1143, and 1144 are inserted into the fixing portion accommodating grooves 1117 does not protrude to the outside of the fixing portion accommodating grooves 1117.

The motor 1142*e* may operate by a fixing body controller 1015. FIG. 4 illustrates a case in which the fixing body controller 1015 is formed in a shape of a push button on a left side surface of the cabinet. When an external force is input to the fixing body controller 1015, the motor 1142*e* will rotate the shafts 1142*a* in a direction in which the fixing bodies 1141, 1142, 1143, and 1144 are withdrawn from the fixing portion accommodating grooves 1117, and when the external force is input to the fixing body controller 1015 once more, the motor 1142*e* may rotate the shafts 1142*a* such that the fixing bodies 1141, 1142, 1143, and 1144 move toward the fixing portion accommodating grooves 1117.

As shown in FIG. 3, the first support 1003 may include a support body 1031 that provides therein a space in which the laundry is supported, and angle adjusting means 1033 pivotably coupling the support body to the cabinet 1001.

The support body 1031 is seated on one of the front surface and the rear surface of the cabinet 1001. When the door 1113 is disposed on the front surface of the cabinet, the support body 1031 may be disposed to be seated on the rear surface of the cabinet 1001. A support accommodating groove 1118 providing therein a space in which at least a portion of a bottom surface of the support body 1031 is accommodated may be defined in the rear surface of the cabinet 1001. The support accommodating groove 1118 may be defined as a groove obtained as the rear surface of the cabinet 1001 is concavely bent inwardly of the cabinet 1001.

The cabinet 1001 has a slot 1116 providing a movement path of the angle adjusting means 1033. That is, one end of the angle adjusting means 1033 may be pivotably fixed to the cabinet 1001, and the other end of the angle adjusting means 1033 may be inserted into the slot 1116 and fixed to the support body 1031.

The angle adjusting means 1033 may include an adjusting means body 1331 having one end fixed to the support body 1031 and the other end inserted into the slot 1116, and a pivoting shaft 1332 for pivotably connecting the adjusting means body 1331 to the cabinet 1001.

The first support 1003 may further include a position fixing portion 1035 for maintaining the support body 1031 positioned on the top surface of the cabinet 1001. The position fixing portion 1035 may include a bar 1351 having one end fixed to the cabinet 1001 so as to be pivotable via a bar pivoting shaft 1353, and the other end detachably fixed to the support body 1031. FIG. 3 illustrates a case in which a free end of the bar 1351 is inserted into a stopper 1317 defined in a bottom surface of the support body 1031 so as to fix the position of the support body 1031 as an example. The stopper 1317 may be defined as a groove obtained as the bottom surface of the support body 1031 is concavely bent.

As shown in FIG. 4, the bar 1351 may be withdrawn from the bar accommodating groove 1119 defined in the cabinet 1001. In this case, the bar accommodating groove 119 may be defined as a groove in which the bottom surface of the support accommodating groove 1118 is concavely bent toward a center of the cabinet, and the bar pivoting shaft 1353 may connect one end of the bar 1351 to the bar accommodating groove 1119.

As shown in FIG. 3, a seating portion 1037 may be further disposed on the top surface of the cabinet 1001 or the bottom surface of the support body 1031 so as to maintain a gap between the support body 1031 and the top surface of the cabinet 1001 when the support body 1031 is pivoted to be positioned on the top surface of the cabinet 1001.

The support body 1031 may have an accommodating portion 1311 defining a space in which a fan 1312 is mounted and a flow path of air. A first through-hole 1313 passing through the support body to be in communication with the accommodating portion 1311 may be defined in the top surface of the support body 1031, and a second through-hole 1315 passing through the support body to be in communication with the accommodating portion 1311 may be defined in the bottom surface of the support body.

When the fan 1312 operates in a state in which the laundry is seated on the top surface of the support body 1031, air will be introduced into the accommodating portion 1311 through the first through-hole 1313 and air inside the accommodating portion 1311 will be discharged through the second through-hole 1315. Because the support 1003 having the above structure may fix the laundry to the top surface of the support body 1031, shaking of the laundry may be minimized when the treating means 1007 is ironed.

As shown in FIG. 2, the utility unit 1005 includes a body 1051 that is able to be withdrawn from the second housing 1012 through the outlet 1112.

The body 1051 may receive power so as to be withdrawn from the second housing 1012 via a body withdrawing portion 1052. The body withdrawing portion 1052 may include a rack 1521 fixed to the second housing along a longitudinal direction of the second housing 1012, a pinion 1523 rotatably disposed on the body 1051 and coupled to the rack, and a pinion motor (not shown) that rotates the pinion.

A connector fixing portion (a connector first fixing portion) 1059 is disposed in a space in a space provided by the body 1051 exposed to the outside of the second housing 1012 when withdrawn from the second housing 1012. FIG. 2 illustrates a case in which the connector first fixing portion 1059 is defined as a groove defined in the top surface of the body 1051 as an example.

A power line fastening portion 1593 and a flow path fastening portion 1591 may be disposed in the connector first fixing portion 1059. The power line fastening portion 1593 may be connected to the cabinet power line 1019 via an electric wire, and the flow path fastening portion 1591 may be connected to the discharge port 1163 of the steam generator via a connecting tube 1595. Because the body 1051 is withdrawable from the second housing 1012, the electric wire and the connecting tube may be formed in a structure that is stretchable along a movement direction of the body 1051.

Figure 5:
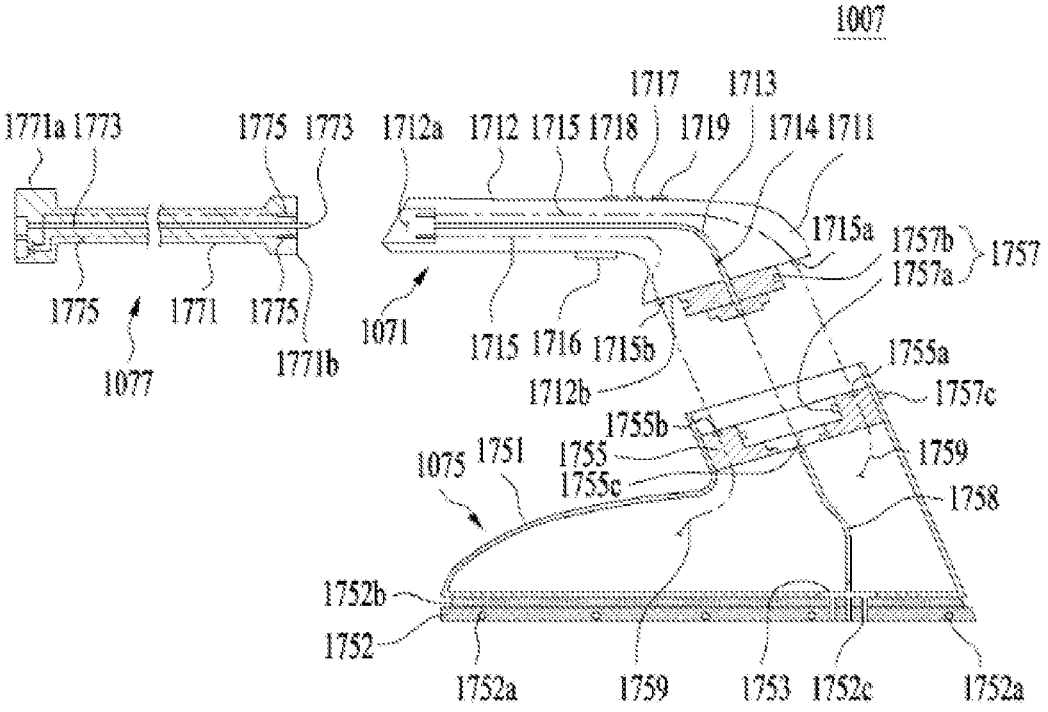
FIG. 5 shows an example of treating means.

As shown in FIG. 5, the treating means 1007 may include a steam supply 1071 connected to the steam generator 1016 and the power supply via a connector 1077, and a heat supply 1075 detachably fixed to the steam supply. The heat supply 1075 may not only be able to supply steam supplied via the steam generator 1016 to the laundry, but also may supply heat to the laundry via a heating plate 1752 that radiates heat when power is supplied thereto.

The connector 1077 may include a connector body 1771, a flow path connecting portion 1773 disposed inside the connector body 1771 to supply steam discharged from the flow path fastening portion 1591 to the treating means 1007, and a power line connecting portion 1775 disposed inside the connector body 1771 to supply power supplied from the power line fastening portion 1593 to the treating means 1007.

One end of the connector body 1771 may include a first fastening end 1771*a* detachably connected to the connector first fixing portion 1059 of the utility unit, and the other end of the connector body 1771 may include a second fastening end 1771*b* detachably connected to the treating means 1007.

The steam supply 1071 may include a steam supply body 1711 having a bar-shaped handle 1712. A connector fixing portion (a connector second fixing portion) 1712*a* to which the second fastening end 1771*b* of the connector is detachably fixed may be defined at one end of the steam supply body 1711.

A first flow path 1713 providing a flow path through which steam moves is defined inside the steam supply body 1711. One end of the first flow path 1713 may be defined at the connector second fixing portion 1712*a*, and the other end thereof may be defined to extend through a contact surface (a surface in contact with the heat supply) 1712*b* disposed in the steam supply body 1711. Therefore, when the second fastening end 1771*b* of the connector is inserted into the connector second fixing portion 1712*a*, the first flow path 1713 will be connected to the steam generator 1016 via a flow path connecting portion 1773 disposed in the connector and a connecting tube 1595 disposed in the utility body.

A flow path valve 1714 may be disposed in the first flow path 1713, and the flow path valve 1714 may open or close the first flow path by a valve controller 1716 disposed on the steam supply body 1711. As shown in the drawing, the valve controller 1716 may be disposed on a handle 1712.

A first power line 1715 is disposed inside the steam supply body 1711. A first terminal 1715*a* and a second terminal 1715*b* for supplying power to the heat supply 1075 are disposed on the contact surface 1712*b* of the steam supply body. The first power line 1715 is means for connecting the terminals 1715*a* and 1715*b* to the power line connecting portion 1775 disposed in the connector.

That is, the first power line may include an electric wire having one end connected to the first terminal 1715*a* and the other end fixed to the connector second fixing portion 1712*a*, and an electric wire having one end connected to the second terminal 1715*b* and the other end fixed to the connector second fixing portion 1712*a*. Therefore, when the second fastening end 1771*b* of the connector is inserted into the connector second fixing portion 1712*a*, the terminals 1715*a* and 1715*b* may be connected to the cabinet power line 1019 via the first power line 1715, a power line connecting portion 1775, and the power line fastening portion 1593.

The first power line 1715 may be constructed to be opened (to cut off power supply to the terminals) or to be closed (to supply power to the terminals) by a heating plate power controller 1717 disposed on the steam supply body 1711. That is, the steam supply 1071 may have a switch for opening or closing the first power line 1715, and the heating plate power controller 1717 may control a position of the switch. The drawing shows a case in which the heating plate power controller 1717 is disposed on the handle 1712 as an example.

The steam supply body 1711 may include a fan controller 1718 for controlling a fan 1312 disposed in the support body 1031. The fan controller 1718 may control whether to operate the fan 1312, the number of rotations of the fan, and the like, and is preferably disposed on the handle 1712 in consideration of ease of use.

Furthermore, the steam supply body 1711 may have a display (a handle display) 1719 for displaying an amount of water stored in the storage 1161 of the steam generator. The display 1719 may notify the user of the water level of the storage 161 detected by the water level detecting means 1169, and may be constructed as a lamp that is turned on only when the water level inside the storage is equal to or lower than a preset reference water level. In consideration of the convenience of use, it is preferable that the display 1719 is disposed on the top surface of the handle 1712.

The heat supply 1075 may include a heat supply body 1751 to which the steam supply body 1711 is fixed, the heating plate 1752 disposed on a bottom surface of the heat supply body 1751 to radiate heat when power is supplied thereto, and connecting portions 1755 and 1757 for detachably connecting the steam supply body 1711 to the heat supply body 1751.

The heat supply body 1751 may have any shape as long as it is able to provide a space in which the heating plate 1752 is fixed and a space in which the contact surface 1712*b* of the steam supply body 1711 is fixed.

The connecting portion may include a connecting body 1755 fixed to a top surface of the heat supply body 1751, and a fastening body 1757 for fastening the steam supply body 1711 to the connecting body 1755.

The connecting body 1755 has a first connecting terminal 1755*a* and a second connecting terminal 1755*b*. When the steam supply body 1711 is fixed to the heat supply body 1751, the first connecting terminal 1755*a* should be in contact with the first terminal 1715*a* disposed on the steam supply and the second connecting terminal 1755*b* should be in contact with the second terminal 1715*b* disposed on the steam supply.

In addition, the connecting body 1755 has a communication hole 1755*c* for communicating an interior of the heat supply body 1751 with the outside. When the steam supply body 1711 is fixed to the heat supply body 1751, the communication hole 1755*c* should be connected to the first flow path 1713 of the steam supply.

The fastening body 1757 may include an accommodating groove 1757*b* defined in the steam supply body 1711, a fixing protrusion 1757*a* disposed on the connecting body 1755 and detachably coupled to the accommodating groove 1757*b*, and a fixing portion lock 1757*c* for controlling a position of the fixing protrusion 1757*a*.

The fixing portion lock 1757*c* may be constructed as a slide button disposed on a side surface of the heat supply body 1751. When an external force is input to the slide button (when the slide button is pushed to one side), the fixing protrusion 1757*a* may be withdrawn from the accommodating groove 1757*b*. In addition, when no external force is input to the slide button, the fixing protrusion 1757*a* may maintain the state inserted into the accommodating groove 1757*b*.

The heating plate 1752 may include a heating plate body formed as a conductor and fixed to the bottom surface of the heat supply body 1751, and a heating plate heater 1752*a* disposed inside the heating plate body. An insulating portion 1752*b* for insulating the heating plate body 1752 may be disposed on the bottom surface of the heat supply body 1751.

The heating plate heater 1752*a* receives power via a second power line 1759. That is, the second power line 1759 includes an electric wire for connecting the first connecting terminal 1755*a* with one end of the heating plate heater 1752*a*, and an electric wire for connecting the second connecting terminal 17554*b* with the other end of the heating plate heater 1752*a*. Accordingly, in a state in which the terminals 1715*a* and 1715*b* are respectively connected to the connecting terminals 1755*a* and 1755*b* (in a state in which the steam supply body is coupled to the heat supply body), when the heating plate power controller 1717 closes a power circuit, the heating plate heater 1752*a* will generate heat.

The heating plate 1752 has a steam discharge hole 1752*c* defined to extend through the heating plate body. The steam discharge hole 1752*c* may be connected to the communication hole 1755*c* via the second flow path 1758. Therefore, when the steam supply body 1711 is connected to the heat supply body 1751, steam discharged from the first flow path 1713 may move to the steam discharge hole 1752*c* via the communication hole 1755*c* and the second flow path 1758.

In one example, when the steam discharge hole 1752*c* includes a plurality of holes, the heat supply body 1751 may further include a nozzle 1753. The nozzle 1753 is preferably disposed to supply the steam supplied from the second flow path 1758 to each steam discharge hole 1752*c*.

Figure 6:
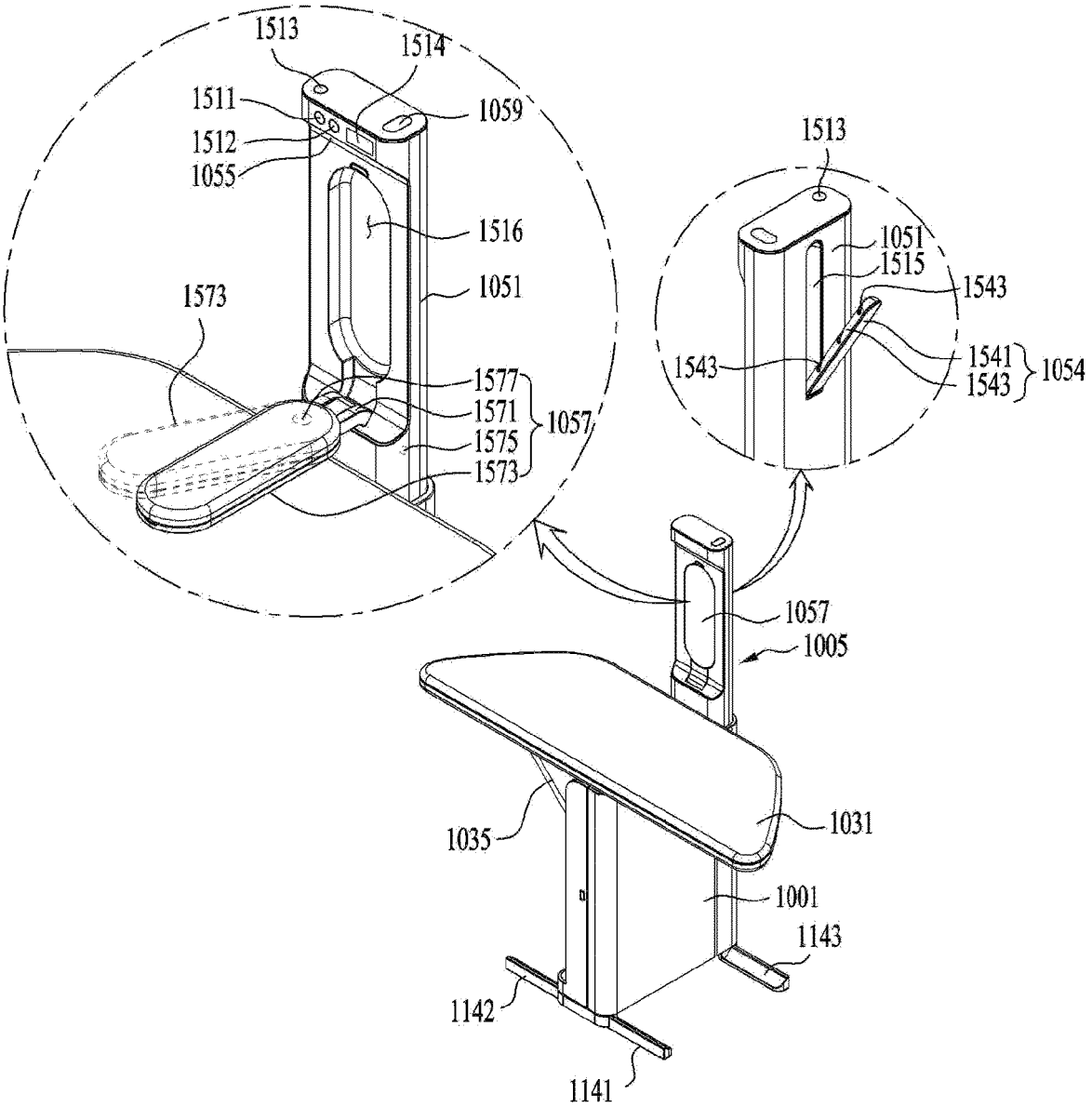
FIG. 6 shows an example of a utility unit.

In order for the utility unit 1005 to perform a function of a main controller, the body 1051 may have input means 1511, 1512, 1513, and a display 1514. As shown in FIG. 6, the input means may include a power controller 1511 for controlling opening and closing of a circuit that connects the heater 1167 of the steam generator with the cabinet power line 1019, and a withdrawal controller 1513 for controlling the pinion motor of the body withdrawing portion 1052.

The power controller 1511 may be disposed on a surface directed in a direction in which the support body 1031 is located of the space provided by the body 1051, and the withdrawal controller 1513 may be disposed on a top surface (a surface that forms the top surface of the cabinet when inserted into the second housing) of the body 1051.

In one example, a lamp 1055 disposed on the body 1051 so as to emit light onto the top surface of the support body 1031 may be further disposed. In this case, the input means may include a lamp controller 1512 that controls an operation of the lamp 1055. The lamp controller 1512 may be disposed on the surface directed in the direction in which the support body 1031 is located of the space provided by the body 1051.

The display 1514 may display information transmitted from the water level detecting means 1169. That is, the display 1514 may notify the user of data detected by the water level detecting means 1169 (data enabling the user to recognize the water level), and may be formed as a lamp that is turned on only when the water level inside the storage is equal to or lower than the preset reference water level.

In one example, the body 1051 may have a second support 1057 serving as a support plate when ironing sleeves or shoulders of a shirt. The second support 1057 may be disposed in the body 1051 and located above the support body 1031, and provide a space in which the laundry is supported, but has an area smaller than an area of the support body 1031.

FIG. 6 illustrates a case in which the second support 1057 includes a first board 1571 fixed to the body 1051 so as to be pivotable toward the top surface of the support body 1031, and a second board 1573 pivotably fixed to the first board 1571 so as to be pivotable in a plane parallel to the top surface of the support body 1031 to provide a space in which the laundry is supported as an example.

The first board 1571 may be pivotably fixed to the body 1051 via a first shaft 1575, and the second board 1573 may be pivotably fixed to the first board 1571 via a second shaft 1577. The first shaft 1575 may be disposed parallel to the top surface of the support body 1031, and the second axis 1577 may be disposed perpendicular to the top surface of the support body 1031. Accordingly, the second board 1573 may be pivotable in a plane parallel to the top surface of the support body 1031 and located at a point higher than the top surface of the support body.

As shown in the drawing, the second support 1057 may be withdrawn from the body 1051. In this case, the body 1051 may have a board accommodating portion 1516 that provides therein a space in which the second support 1057 is accommodated. The board accommodating portion 1516 may be defined as a groove in which a surface facing toward the support body 1031 of the space provided by the body 1051 is concavely bent.

The utility unit 1005 may further include a clothes hanger support 1054 that provides a space in which a hook of the clothes hanger is supported such that the laundry whose treatment process such as the ironing has been completed may be hung in the unfolded state.

When the second support 1057 is disposed on the surface (the front surface of the body) facing toward the first support of the space provided by the body 1051, the clothes hanger support 1054 may be disposed on at least one of a rear surface, a left side surface, a right side surface, and a top surface of the body 1051. The drawing illustrates a case in which the clothes hanger support 1054 is disposed on the rear surface of the body 1051 as an example.

The rear surface of the body 1051 may have a support bar accommodating groove 1515 that provides therein a space in which the clothes hanger support 1054 is accommodated. The support bar accommodating groove 1515 may be defined as a groove in which the rear surface of the body 1051 is concavely bent.

The clothes hanger support 1054 may include a support bar 1541 located in the support bar accommodating groove 1515, a support bar pivoting shaft (not shown) for pivotably fixing a lower end of the support bar to the body 1051, and a hook accommodating portion 1543 defined as a groove in which a surface of the support bar 1541 is concavely bent or formed as a protrusion protruding from the surface of the support bar 1541 to provide a space in which the hook of the clothes hanger is accommodated. Accordingly, the user may, when necessary, withdraw a free end of the support bar 1541 from the support bar accommodating groove 515 and then mount the clothes hanger on the support bar 1541.

Figure 7:
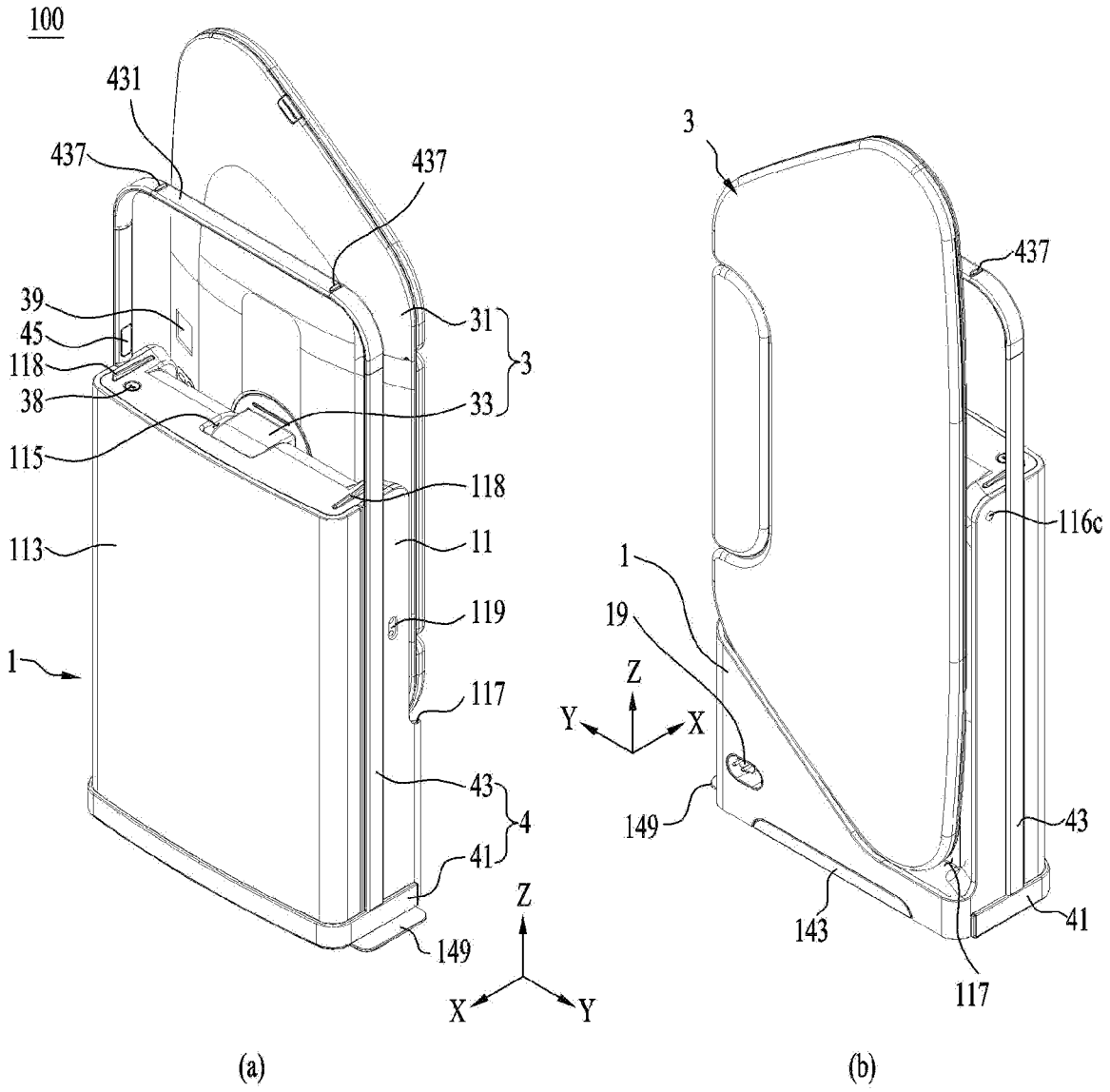
FIG. 7 shows another example of a laundry treating apparatus.

FIG. 7 shows another example of a laundry treating apparatus. As shown in FIG. 7, the laundry treating apparatus 100 includes a body 1 that forms an outer appearance of the apparatus and has a chamber for storage therein, a support 3 that is pivotably fixed to the body 1 and defines a space in which the laundry is supported depending on a pivoting angle, treating means (laundry treating means) 7 that is formed to be withdrawn from an interior of the body 1 so as to supply at least one of heat and steam to the laundry hung on the support 3.

Figure 8:
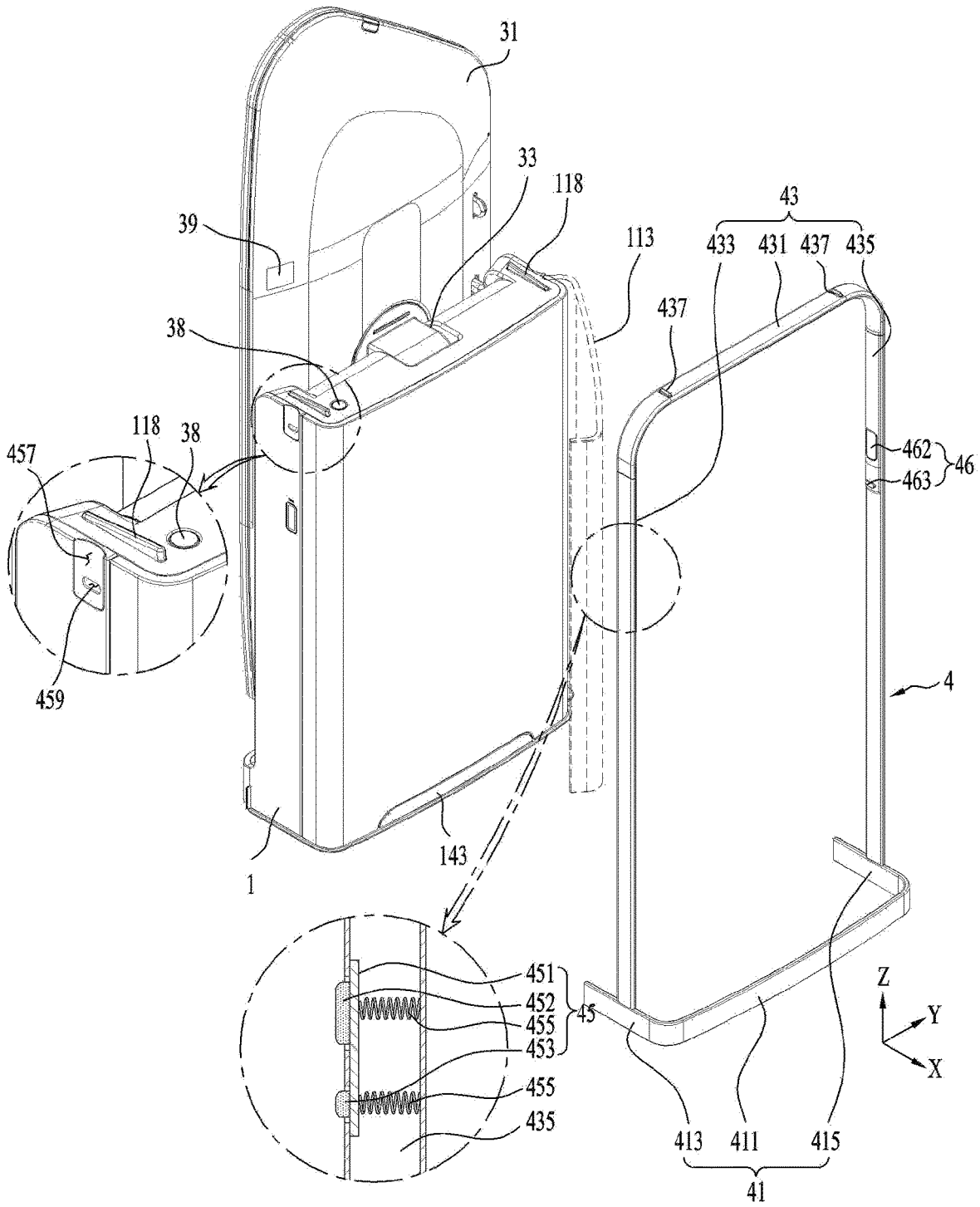
FIG. 8 shows an example of a detachable body disposed in a laundry treating apparatus in FIG. 7.

The laundry treating apparatus 100 may include a detachable body 4 that is detachably fixed to the body 1. The detachable body 4 may function as a handle required to move the laundry treating apparatus 100, or may function as a stand providing a space in which the laundry is hung. That is, the detachable body 4 becomes the handle when being fixed to the body 1, but as shown in FIG. 8, the detachable body 4 separated from the body 1 becomes the stand for the laundry or the clothes hanger.

Figure 9:
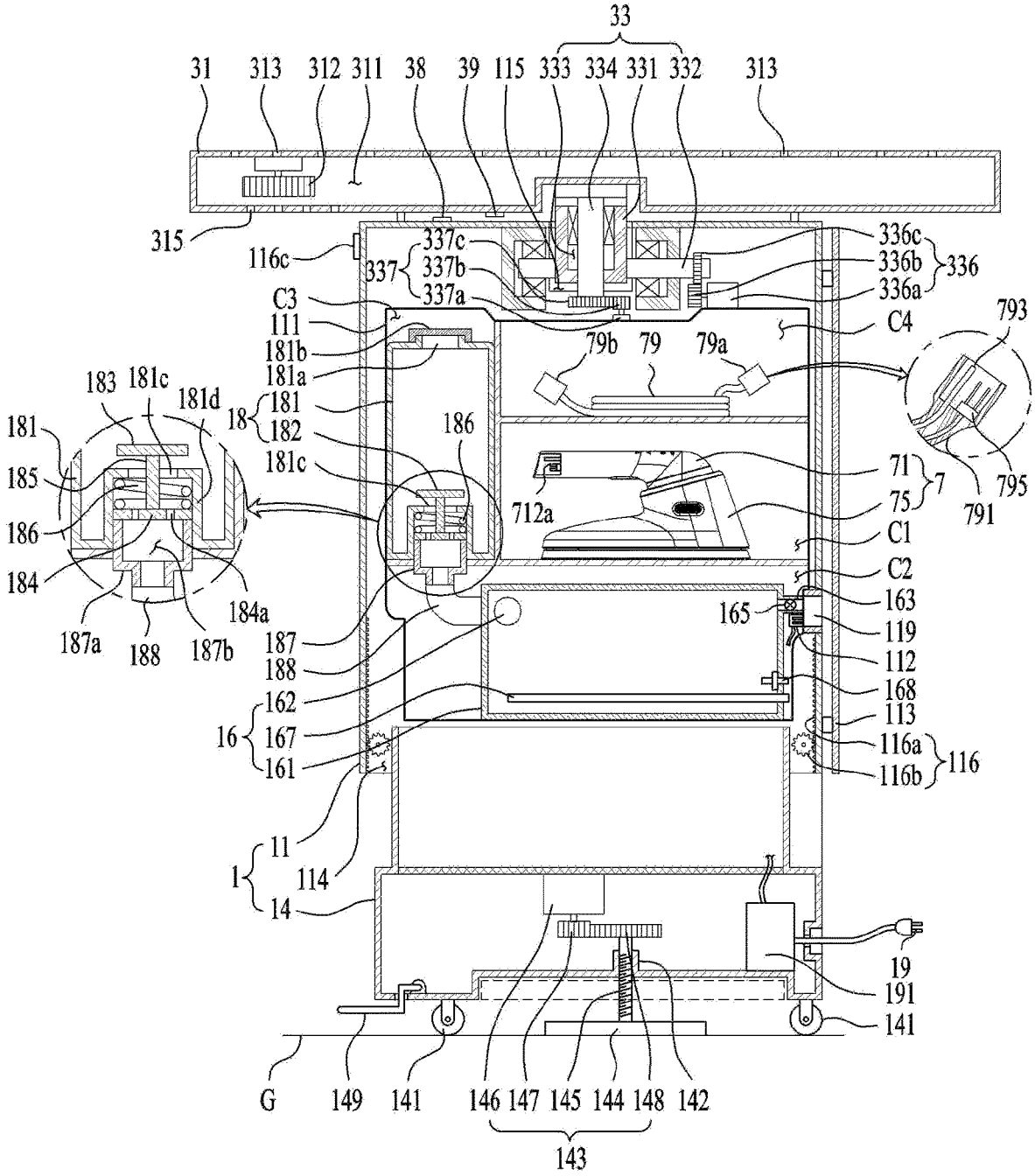
FIGS. 9 and 10 show an example of a support disposed in a laundry treating apparatus in FIG. 7.

As shown in FIG. 9, the body 1 includes a housing 11 and a base 14 for supporting the housing on the floor surface (the ground) of the indoor space. The housing 11 has chambers C1, C2, C3, and C4 therein, the chamber is exposed to the outside of the housing via an inlet 111. A door 113 for opening and closing the inlet 111 is disposed on one surface of the housing 11. FIG. 8 illustrates a case in which the door 113 is pivotably fixed to the housing 11 to form a front surface of the body 1 as an example.

The base 14 may have a wheel 141 that facilitates a movement of the body 1, and a fixing portion 143 for fixing a position of the housing 11 by restricting a rotation of the wheel 141 or separating the wheel 141 from the ground. The wheel 141 may be formed as a disk rotatably fixed to the base 14.

The fixing portion 143 may include a fixing body 144 located between the bottom surface of the base 14 (the bottom surface of the housing) and the ground G, a body pivoting shaft 145 having one end fixed to the fixing body 144 and the other end pivotably fixed to the bottom surface of the base (the bottom surface of the housing), and fixing body drivers 146, 147, and 148 for pivoting the body rotating shaft 145.

The body pivoting shaft 145 may be constructed to adjust a gap between the fixing body 144 and the bottom surface of the base 14. In this case, a first screw thread may be disposed on a circumferential surface of the body pivoting shaft 145, and a shaft fastening portion 142 having a second screw thread coupled to the first screw thread may be disposed on the bottom surface of the base 14. Therefore, when the body pivoting shaft 145 pivots clockwise by the fixing body driver, the fixing body 144 may move in a direction away from the bottom surface of the base 14 (move toward the ground), and when the body pivoting shaft 145 pivots counterclockwise, the fixing body 144 may move toward the bottom surface of the base 14 (move in a direction away from the ground).

The fixing body drivers may include a motor 146 fixed to the base 14, a main gear 147 rotated by a rotation shaft of the motor, and a driven gear 148 fixed to the body pivoting shaft 145 and connected to the main gear 147.

The fixing body driver may provide power causing the fixing body 144 to reciprocate between the bottom surface of the base 14 and a point for separating the wheel 141 from the ground G to the body pivoting shaft 145.

In contrast, the fixing body driver may provide power causing the fixing body 144 to reciprocate between the bottom surface of the base 14 and a point in contact with the ground G to the body pivoting shaft 145.

The fixing body driver may operate by the fixing body controller 149. FIG. 9 illustrates a case in which the fixing body controller 149 controls the operation of the motor 146 as an example. In this case, the motor 146 may rotate the main gear 147 clockwise or counterclockwise while the user steps on the fixing body controller 149. Furthermore, the motor 146 may change a rotation direction of the main gear 147 whenever the user steps on the fixing body controller 149.

That is, the motor 146 may rotate the main gear 147 clockwise when the user steps on the fixing body controller 149, then stop the rotation of the main gear when the user takes a foot thereof off the fixing body controller 149, and then rotate the main gear 147 counterclockwise when the user steps on the fixing body controller 149 again.

The above-described base 14 may be fixed to the housing 11 to form the bottom surface of the housing, or may be withdrawable from the housing 11.

FIG. 9 illustrates as an example a case in which the base 14 is withdrawable from the housing (illustrates as an example a case in which the housing is constructed so as to be able to ascend and descend along a longitudinal direction of the base). That is, an insertion hole 114 may be defined in the bottom surface of the housing 11, and the base 14 may be inserted into the housing 11 via the insertion hole 114. In this case, the laundry treating apparatus 100 may further include a vertical level adjusting assembly 116 for adjusting a vertical level of the housing 11.

The vertical level adjusting assembly 116 may include a rack 116*a* disposed along a longitudinal direction of the housing 11, a pinion 116*b* rotatably fixed to the base 114 and coupled to the rack, and a pinion motor (not shown) that rotates the pinion. The pinion motor is controlled by a pinion motor controller 116*c*. The pinion motor controller 116*c* may be formed as a push button disposed on the housing 11.

Considering that the support 3 must be pivoted to be positioned on the top surface of the housing 11 during the laundry treatment such as the ironing, the pinion motor controller 116*c* is preferably disposed on one of a left side surface, a right side surface, a front surface, and a rear surface of the housing 11. The laundry treating apparatus 100 having the vertical level adjusting assembly 116 described above may adjust a vertical level of the support 3 based on selection of the user, thereby increasing a convenience of use of a tall user.

The chambers disposed in the housing 11 may include a first chamber C1 that provides a space in which the treating means 7 is accommodated, a second chamber C2 in which a steam generator 16 is accommodated, a third chamber C3 in which a water supply tank 18 for supplying water to the steam generator is accommodated, and a fourth chamber C4 in which other objects necessary for the operation of the laundry treating apparatus are accommodated.

The steam generator 16 may include a storage 161 that is disposed in the second chamber C2 and provides a space for storing water therein, and a heater 167 that is disposed in the storage and heats water when power is supplied thereto.

The storage 161 is supplied with water via an inlet hole 162 connected to the water supply tank 18, and steam inside the storage is discharged to the outside of the storage 161 via the discharge port 163. When a valve 165 is disposed in the discharge port 163, steam will be discharged to the outside of the storage 161 when the valve 165 opens the discharge port 163. Water level detecting means 168 for detecting a water level may be further disposed in the storage 161.

The heater 167 may receive power through a body power line 19. The body power line 19 may be withdrawn from a winding assembly 191 disposed in the body 1. FIG. 9 illustrates a case in which the winding assembly 191 is disposed in the base 14 as an example.

The water supply tank 18 may include a tank body 181 that provides a space for storing water and is detachably fixed to the third chamber C3, a water discharge valve 182 disposed on the bottom surface of the tank body 181, a valve actuator 187 fixed to the bottom surface of the third chamber C3 to open the water discharge valve 182, and a water supply pipe 188 having one end connected to the valve actuator 187 and the other end connected to the inlet hole 162 of the steam generator.

A water supply port 181*a* is disposed on the top surface of the tank body 181. The water supply port 181*a* is closed by a lid 181*b* detachably coupled to the tank body 181. A drain hole 181*c* that is opened or closed by the water discharge valve 182 is disposed on the bottom surface of the tank body 181.

A fastening portion 181*d* into which the valve actuator 187 is inserted may be disposed on the bottom surface of the tank body 181. In this case, the drain hole 181*c* may be defined to discharge water inside the tank body 181 to the fastening portion 181*d*.

The water discharge valve 182 may include a first valve body 183 disposed in the tank body 181 to close the drain hole 181*c*, a second valve body 184 located in the fastening portion 181*d*, a connecting bar 185 inserted into the drain hole 181*c* to connect the first valve body and the second valve body to each other, and a valve body through-hole 184*a* defined in the second valve body. The fastening portion 181*d* has a spring 186 for maintaining the first valve body 183 in the state of closing the drain hole 181*c*.

The valve actuator 187 may include an actuator body 187*a* fixed to the bottom surface of the third chamber C3, and a body through-hole 187*b* defined to extend through the actuator body. When the user inserts the tank body 181 into the third chamber C3, the actuator body 187*a* is inserted into the fastening portion 181*d*. When the actuator body 187*a* is inserted into the fastening portion 181*d*, the water discharge valve 182 opens the drain hole 181*c*, and when the drain hole 181*c* is opened, water in the tank body will be supplied to the steam generator 16 through the water supply pipe 188.

Steam discharged from the discharge port 163 of the steam generator 16 may be supplied to the treating means 7 via a connector 79. The connector 79 may include a connector body 791, a flow path connecting portion 793 disposed inside the connector body 791 to connect the discharge port 163 and the treating means 7 to each other, and a power line connecting portion 795 disposed inside the connector body 791 to supply power supplied from the body power line 19 to the treating means 7.

One end of the connector body 791 may have a first fastening end 79*a* detachably connected to the treating means 7, and the other end of the connector body 791 may have a second fastening end 79*b* detachably connected to the discharge port 163.

The body 1 may have a connector fixing portion (a connector first fixing portion) 119 to which the second fastening end 79*b* is detachably fixed. FIG. 9 illustrates a case in which the connector first fixing portion 119 is disposed on the right side surface of the housing 11 as an example.

In this case, it is preferable that a power terminal 112 connected to the body power line 19, and the discharge port 163 of the steam generator are exposed to the outside of the housing 11 via the connector first fixing portion 119. It is to cause the flow path connecting portion 793 to be connected to the discharge port 163 and cause the power line connecting portion 795 to be connected to the power terminal 112 when the user only inserts the second fastening end 79*b* into the connector first fixing portion 119.

The treating means 7 may include a steam supply 71 connected to the steam generator 16, and a heat supply 75 that is detachably fixed to the steam supply. In this case, the first fastening end 79*a* may be detachably connected to a connector fixing portion (a connector second fixing portion) disposed in one of the steam supply and the heat supply. FIG. 9 illustrates a case in which the connector second fixing portion 712*a* is disposed in the steam supply 71.

As shown in FIG. 7, the support 3 may include a support body 31 providing a space in which the laundry is supported, and angle adjusting means 33 for pivotably connecting the support body to the housing 11.

The support body 31 is seated on one of the front surface and the rear surface of the housing 11. When the door 113 is disposed on the front surface of the housing 11, the support body 31 may be supported on the rear surface of the housing 11. That is, as shown in FIG. 7, a support accommodating groove 117 that provides a space in which at least a portion of a bottom surface of the support body 31 is accommodated may be defined in the rear surface of the housing 11. The support accommodating groove 117 may be defined as a groove in which the rear surface of the housing 11 is concavely bent inwardly of the housing 11.

The housing 11 has a slot 115 that provides a movement path of the angle adjusting means 33. That is, one end of the angle adjusting means 33 may be pivotably fixed to the housing 11, and the other end of the angle adjusting means 33 may be inserted into the slot 115 and fixed to the support body 31.

As shown in FIG. 9, the angle adjusting means 33 may include a shaft support 331 inserted into the slot 115, a first pivoting shaft 334 having one end pivotably fixed to the shaft support 331 and the other end fixed to the support body 31, and a second pivoting shaft 332 for pivotably fixing the shaft support 331 to the housing 11.

The shaft support 331 may have a shaft accommodating portion 333. In this case, the first pivoting shaft 334 may be pivotably fixed to the accommodating portion 333 via a bearing. The second pivoting shaft 332 is means for causing the shaft support 331 to pivot along a path provided by the slot 115.

Figure 10:
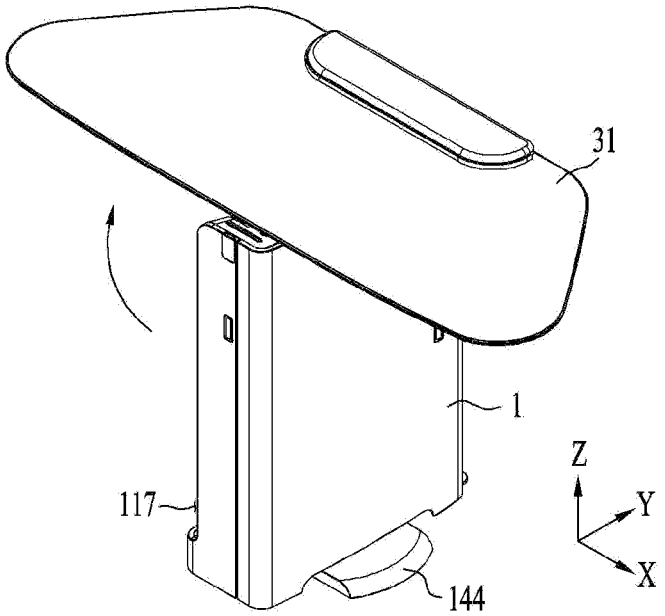
Figure 10:
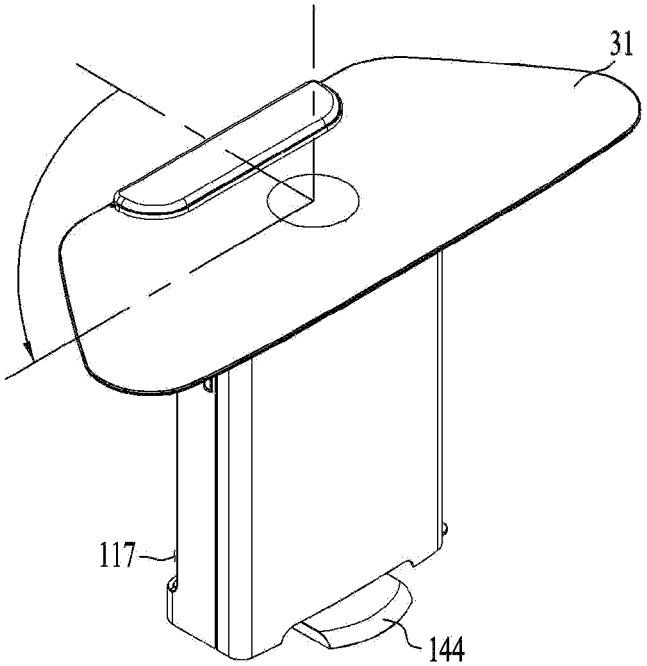

As shown in (a) in FIG. 10, the support body 31 is pivotable from the support accommodating groove 117 to the top surface of the housing 11 by the second pivoting shaft 332. In addition, as shown in (b) in FIG. 10, the support body 31 may pivot in a plane parallel to the top surface of the housing 11 by the first pivoting shaft 334.

As shown in FIG. 9, the support 3 may further include a second shaft driver 336 for pivoting the second pivoting shaft 332, and a first shaft driver 337 for pivoting the first pivoting shaft 334.

As shown in FIG. 9, the first shaft driver 337 may include a first shaft motor 337*a* disposed in the housing 11, a first shaft main gear 337*b* rotated by the first shaft motor, and a first shaft driven gear 337*c* fixed to the first pivoting shaft 334 and connected to the first shaft main gear.

The second shaft driver 336 may include a second shaft motor 336*a* disposed in the housing 11, a second shaft main gear 336*b* rotated by the second shaft motor, and a second shaft driven gear 336*c* fixed to the second pivoting shaft 332 and connected to the second shaft main gear.

The laundry treating apparatus 100 may further include driver first operating means 38 for sequentially operating the second shaft driver 336 and the first shaft driver 337, and driver second operating means 39 for sequentially operating the first shaft driver 337 and the second shaft driver 336.

In a state in which the laundry treating apparatus 100 is not operating (the state in which the support body is seated in the support accommodating groove, the state of FIG. 7), a portion of the top surface of the housing 11 and a portion of the bottom surface of the support body 31 remain exposed to the outside of the body 1. Accordingly, the driver first operating means 38 may be disposed at any position on the top surface of the housing 11 or on the bottom surface of the support body 31.

However, when the support body 31 is located on the housing 11 by the driver first operating means 38, it is difficult for the user to access the top surface of the housing 11, so that the driver second operating means 39 is preferably disposed on the support body 31. FIG. 9 illustrates a case in which the driver second operating means 39 is disposed on the bottom surface 9 (a surface directed in a direction in which the driver first operating means is located of the space provided by the support body) of the support body 31 as an example.

The support body 31 may have therein an accommodating portion 311 for defining a space in which a fan 312 is mounted and defining a flow path of air. A first through-hole 313 extending through the support body and in communication with the accommodating portion 311, and a second through-hole 315 extending through the bottom surface of the support body and in communication with the accommodating portion 311 may be defined in the top surface of the support body 31.

When the fan 312 operates in a state in which the laundry is seated on the top surface of the support body 31, air will be introduced into the accommodating portion 311 via the first through-hole 313 and air inside the accommodating portion 311 will be discharged via the second through-hole 315. Because the support 3 having the above structure is able to fix the laundry to the top surface of the support body 31, shaking of the laundry may be minimized when ironing with the treating means 7.

A seating portion 118 may be formed on the top surface of the housing 11 such that shaking of the support body 31 may be minimized by maintaining a gap between the support body 31 and the top surface of the housing 11. As shown in FIG. 7, the seating portion 118 may be formed as a protrusion protruding from the top surface of the housing 11 to maintain a gap between the bottom surface of the support body 31 and the top surface of the housing 11.

Considering that the support body 31 is pivotable about the first pivoting shaft 334, it is preferable that the top surface of the seating portion 118 is inclined upward along a pivoting direction of the support body 31.

As shown in FIG. 8, the detachable body 4 may include a first frame 41 formed in a shape that may accommodate the front surface of the housing 11, the left side surface of the housing, and the right side surface of the housing, a second frame 43 fixed to the first frame 41 and in contact with both side surfaces of the housing 11, and detachable portions 45 and 46 disposed on the second frame 43 to detachably fix the second frame 43 to the housing 11.

The first frame 41 may include a bar-shaped frame body 411 in contact with the front surface of the housing 11, a bar-shaped first bent portion 413 disposed at one end of the frame body 411 and in contact with the left side surface of the housing 11, and a bar-shaped second bent portion 415 disposed at the other end of the frame body 411 and in contact with the right side surface of the housing 11.

Unlike the drawing, the first frame 41 may be formed in a shape corresponding to a shape formed by the rear surface, the left side surface, and the right side surface of the housing 11. In this case, the frame body 411 should be in contact with the rear surface of the housing 11.

The second frame 43 may include a first connecting bar 433 formed as a bar having one end fixed to the first bent part 413 and the other end located at a point higher than an upper end of the housing 11, a second connecting bar 435 formed as a bar having one end fixed to the second bent part 415 and the other end located at a point higher than the upper end of the housing 11, and a support bar 431 disposed to connect a free end of the first connecting bar and a free end of the second connecting bar to each other. The support bar 431 provides a space that the user may grip by hand and a space in which the hook of the clothes hanger is supported.

The support bar 431 may further include a hook accommodating portion 437. The hook accommodating portion 437 may be formed as at least two protrusions protruding from the top surface of the support bar 431. It is preferable that one protrusion is disposed to be spaced apart from the other protrusion to define a space in which the hook of the clothes hanger is accommodated.

Unlike the drawing, the hook accommodating portion 437 may be defined as a plurality of grooves (a space in which the hook of the clothes hanger is accommodated) in which the top surface of the support bar 431 is concavely bent.

The detachable portions may include a first detachable portion 45 for detachably fixing the first connecting bar 433 to the left side surface of the housing 11, and a second detachable portion 46 for detachably fixing the second connecting bar 435 to the right side surface of the housing 11.

The first detachable portion 45 may include a first mounting groove 457 defined in the left side surface of the housing 11, a first fastening groove 459 defined in the first mounting groove, a first detachable body 451 disposed inside the first connecting bar 433, a first fastening protrusion 453 and a first transfer protrusion 452 fixed to the first detachable body 451 through the first connecting bar 433, and a first pressing portion 455 for pressing the first detachable body 451.

The first mounting groove 457 may be defined along the longitudinal direction of the housing 11 to define a space in which the first connecting bar 433 is accommodated.

The first fastening protrusion 453 is formed to be inserted into the first fastening groove 459. The first transfer protrusion 452 may move the first detachable body 451 in a direction in which the first fastening protrusion 453 is separated from the first fastening groove 459 when an external force is input, and the first pressing portion 455 may be formed as a spring that presses the first detachable body 451 in a direction in which the first fastening protrusion 453 is inserted into the first fastening groove 459 when the external force input to the first transfer protrusion 452 disappears.

The second detachable portion 46 may be formed in the same structure as the first detachable portion 45. That is, the second detachable portion 46 may include a second mounting groove defined in the right side surface of the housing 11, a second fastening groove defined in the second mounting groove, a second detachable body disposed inside the second connecting bar, a second fastening protrusion 463 that extends through the second connecting bar and is fixed to the second detachable body and is coupled to the second fastening groove, a second transfer protrusion 462 that extends through the second connecting bar and is fixed to the second detachable body and moves the second detachable body in a direction in which the second fastening protrusion is separated from the second fastening groove when an external force is input, and a second pressing portion for pressing the second detachable body in a direction in which the second fastening protrusion is coupled to the second fastening groove.

Figure 11:
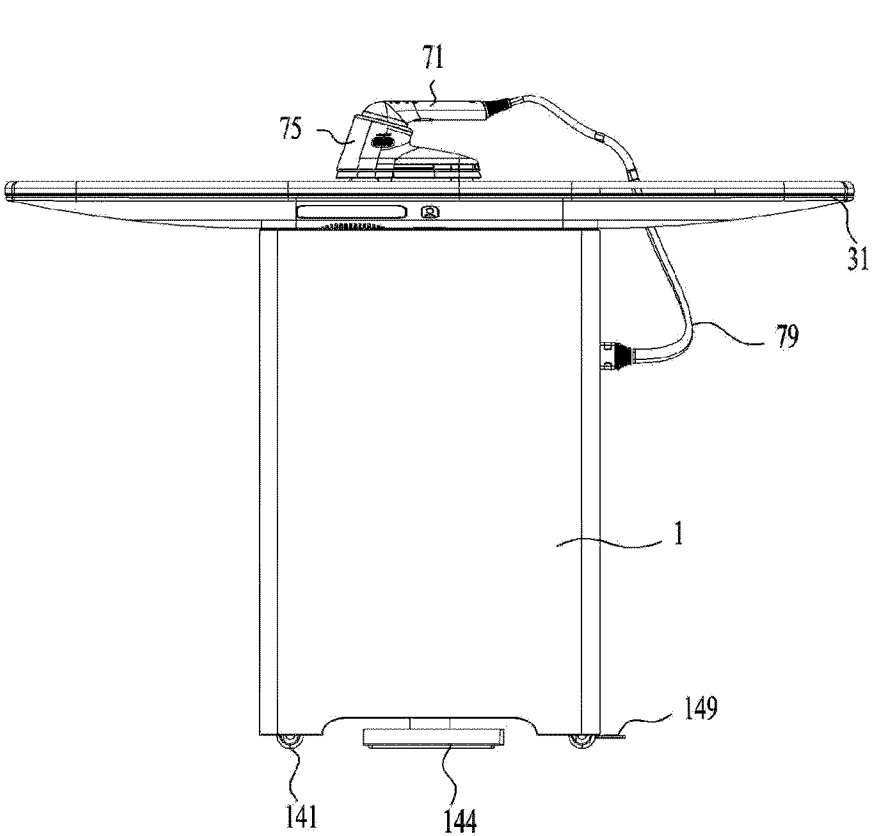
FIG. 11 shows an example of use of a detachable body.
Figure 11:
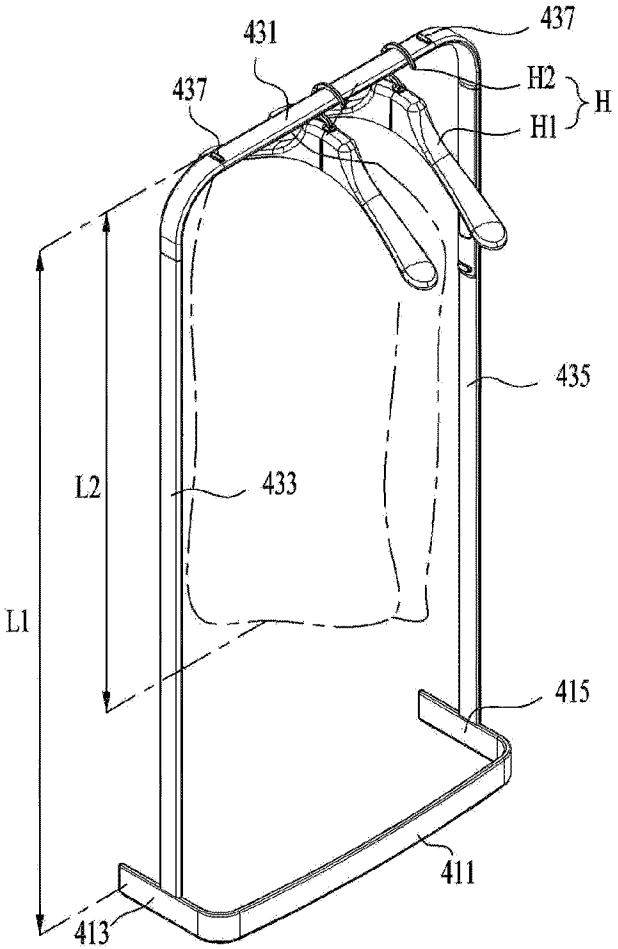

As shown in FIG. 11, a vertical dimension of the support bar 431 is preferably set to a vertical dimension that allows the laundry hung on a clothes hanger H to maintain the unfolded state. That is, the vertical dimension of the support bar 431 (a length from the ground to an upper end of the support bar, L1) is preferably set greater than a length L2 from the upper end of the support bar to a lower end of the laundry (the shirt, pants, and the like) hung on a clothes hanger body H1.

The detachable body 4 fixed to the body 1 functions as a handle for the user to control a moving direction of the body 1, but the detachable body 4 separated from the body 1 functions as a stand for the laundry. Accordingly, the laundry treating apparatus 100 may mount the laundry whose treatment process such as the ironing has been completed in the unfolded state.

Figure 12:
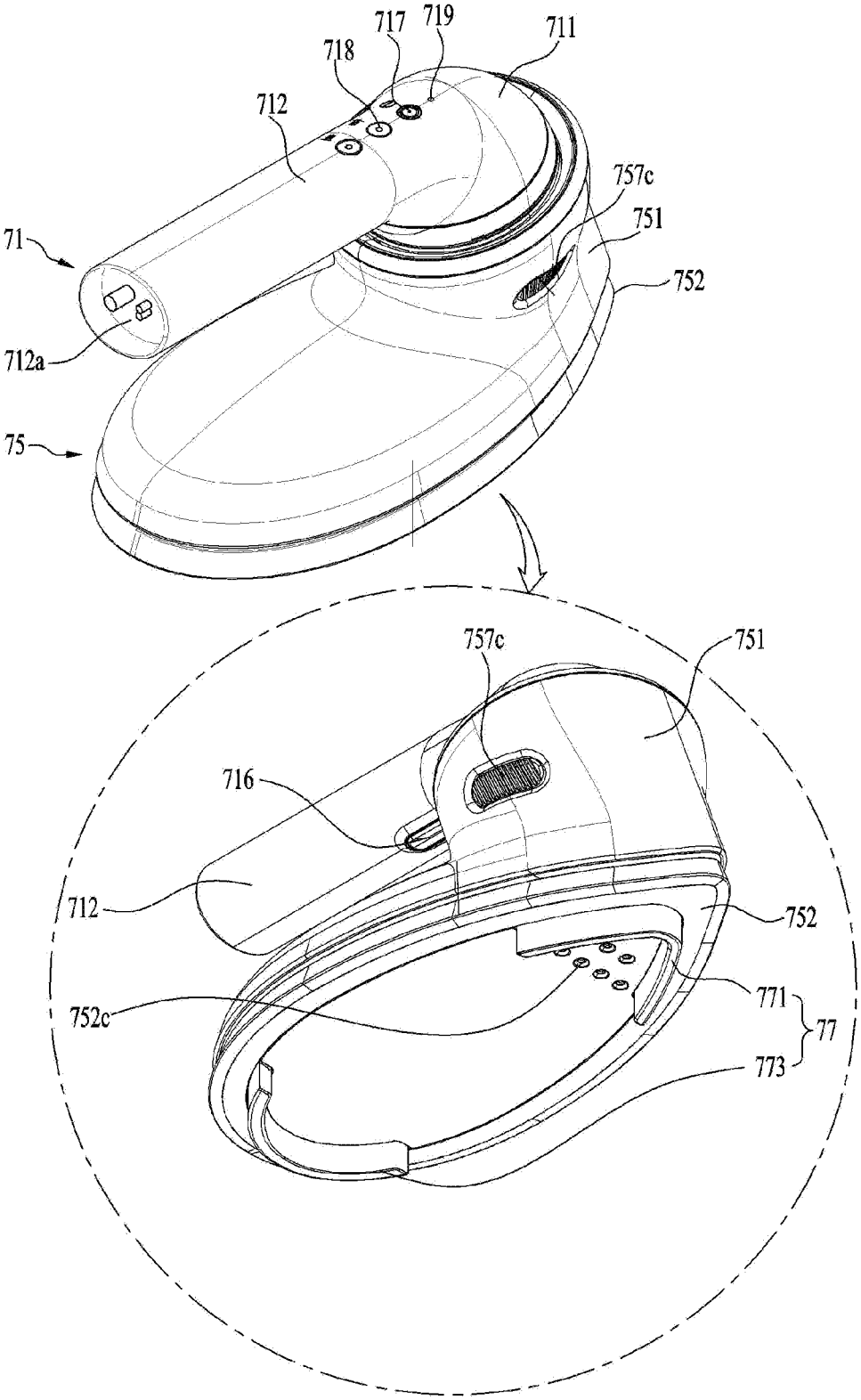
FIGS. 12, 13, and 14 show an example of treating means disposed in a laundry treating apparatus in FIG. 7.

As shown in FIG. 12, the treating means 7 may include a steam supply 71 connected to the steam generator 16 via the connector 79, and a heat supply 75 that is detachably fixed to the steam supply. The heat supply 75 may not only be able to supply steam supplied via the steam generator 16 to the laundry, but also may supply heat to the laundry via a heating plate 752 that dissipates heat when power is supplied thereto.

Figure 13:
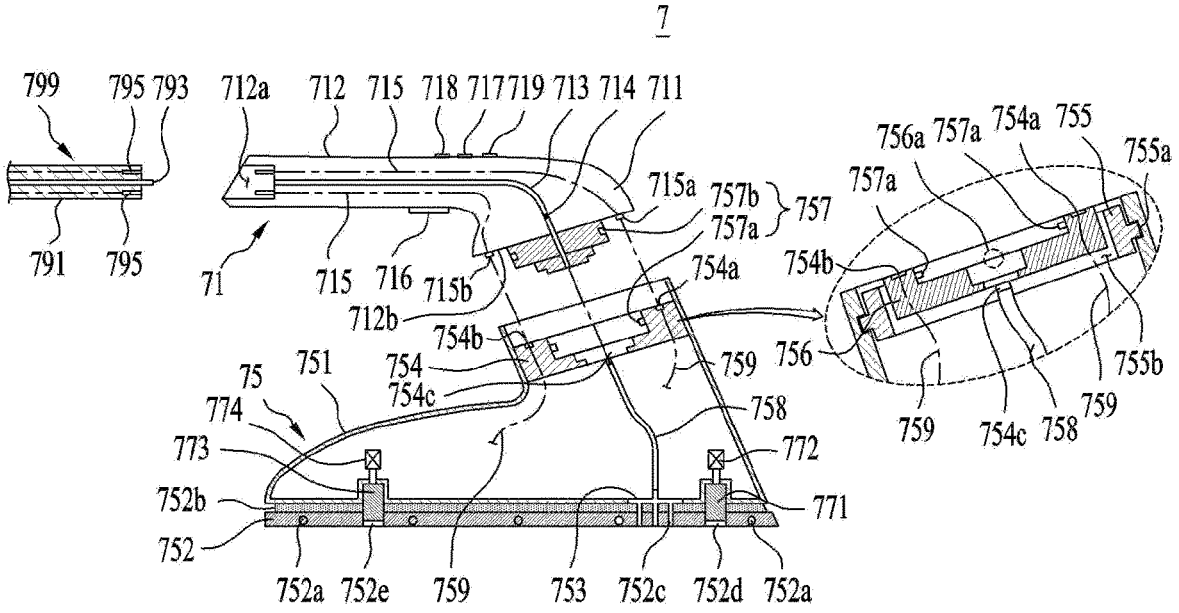

As shown in FIG. 13, the steam supply 71 may include a steam supply body 711 having a bar-shaped handle 712. One end of the steam supply body 711 may be detachably fixed to the heat supply 75 via connecting portions 754 and 757 to be described later. The connector second fixing portion 712*a* may be disposed at a free end of the steam supply body 711.

A first flow path 713 that provides a flow path through which steam moves is defined inside the steam supply body 711. One end of the first flow path 713 may be exposed to the connector second fixing portion 712*a*, and the other end of the first flow path 713 may extend through a contact surface (a surface in contact with the heat supply) 712*b* disposed on the steam supply body 711. Therefore, when the connector first fastening end 79*a* is inserted into the connector second fixing portion 712*a*, the first flow path 713 will be connected to the steam generator 16 via a flow path connecting portion 793 disposed in the connector.

The first flow path 713 may have a flow path valve 714. The flow path valve 714 may open or close the first flow path by a valve controller 716 disposed in the steam supply body 711. As shown in the drawing, the valve controller 716 may be disposed on the handle 712.

A first power line 715 is disposed inside the steam supply body 711. A first terminal 715*a* and a second terminal 715*b* for supplying power to the heat supply 75 are disposed on the contact surface 712*b* of the steam supply body, and the first power line 715 is means for connecting the terminals 715*a* and 715*b* to the power line connecting portion 795 disposed in the connector.

That is, the first power line may include an electric wire having one end connected to the first terminal 715*a* and the other end fixed to the connector second fixing portion 712*a*, and an electric wire having one end connected to the second terminal 715*b* and the other end fixed to the connector second fixing portion 712*a*. Therefore, when the connector first fastening end 79*a* is inserted into the connector second fixing portion 712*a*, the terminals 715*a* and 715*b* will be connected to the body power line 19 via the first power line 715, a power line connecting portion 795, and a power terminal 112.

The first power line 715 may be constructed to be opened (to cut off power supply to the terminals) or to be closed (to supply power to the terminals) by a power controller 717 disposed on the steam supply body 711. That is, the steam supply 71 may have a switch for opening or closing the first power line 715, and the power controller 717 may control a position of the switch. The drawing shows a case in which the power controller 717 is disposed on the handle 712 as an example.

The steam supply body 711 may include a fan controller 718 for controlling a fan 312 disposed in the support body 31. The fan controller 718 may control whether to operate the fan 312, the number of rotations of the fan, and the like, and is preferably disposed on the handle 712 in consideration of ease of use.

Furthermore, the steam supply body 711 may have a display 719 for displaying an amount of water stored in the storage 161 of the steam generator. The display 719 may notify the user of the water level of the storage 161 (data measured by the water level detecting means) detected by the water level detecting means 168, and may be constructed as a lamp that is turned on only when the water level inside the storage is equal to or lower than a preset reference water level. In consideration of the convenience of use, it is preferable that the display 719 is disposed on the top surface of the handle 712.

As shown in FIG. 12, the heat supply 75 may include a heat supply body 751 to which the steam supply body 711 is fixed, the heating plate 752 disposed on a bottom surface of the heat supply body 751 to radiate heat when power is supplied thereto, and connecting portions 754 and 757 for detachably connecting the steam supply body 711 to the heat supply body 751.

The heat supply body 751 may have any shape as long as it is able to provide a space in which the heating plate 752 is fixed and a space in which the contact surface 712*b* of the steam supply body 711 is fixed.

Figure 14:
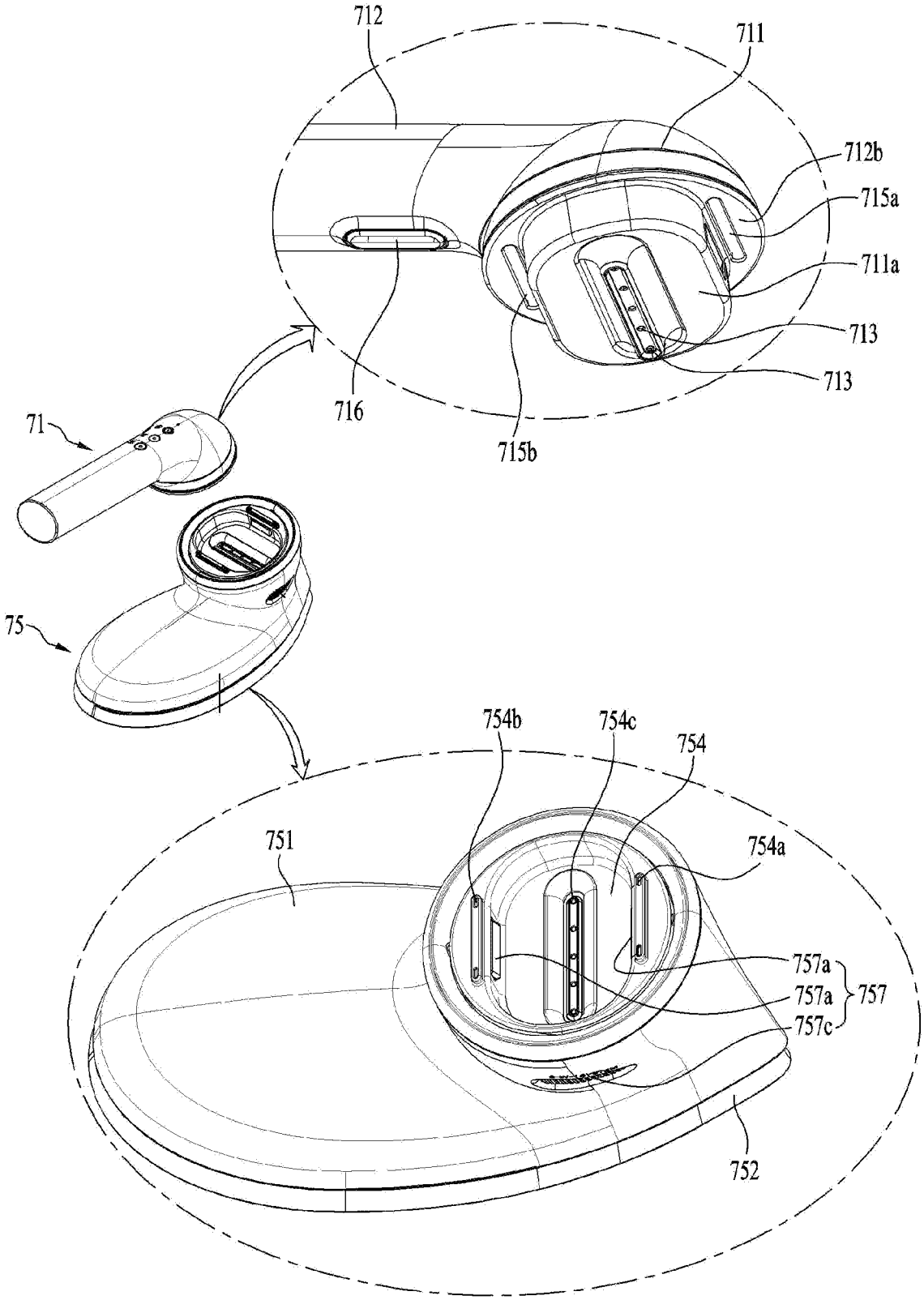

As shown in FIG. 14, the connecting portion may include a connecting body 754 fixed to a top surface of the heat supply body 751, and a fastening body 757 for fastening the steam supply body 711 to the connecting body 754.

The connecting body 754 has a first connecting terminal 754*a* and a second connecting terminal 754*b*. When the steam supply body 711 is fixed to the heat supply body 751, the first connecting terminal 754*a* should be in contact with the first terminal 715*a* disposed on the steam supply and the second connecting terminal 754*b* should be in contact with the second terminal 715*b* disposed on the steam supply.

In addition, the connecting body 754 has a communication hole 754*c* for communicating an interior of the heat supply body 751 with the outside. When the steam supply body 711 is fixed to the heat supply body 751, the communication hole 754*c* should be connected to the first flow path 713 of the steam supply.

The fastening body 757 may include an accommodating groove 757*b* (see FIG. 13) defined in the steam supply body 711, a fixing protrusion 757*a* disposed on the connecting body 754 and detachably coupled to the accommodating groove 757*b*, and a fixing portion lock 757*c* for controlling a position of the fixing protrusion 757*a*.

The fixing portion lock 757*c* may be constructed as a slide button disposed on a side surface of the heat supply body 751. When an external force is input to the slide button (when the slide button is pushed to one side), the fixing protrusion 757*a* may be withdrawn from the accommodating groove 757*b*. In addition, when no external force is input to the slide button, the fixing protrusion 757*a* may maintain the state inserted into the accommodating groove 757*b*.

As shown in FIG. 13, the heating plate 752 may include a heating plate body formed as a conductor and fixed to the bottom surface of the heat supply body 751, and a heating plate heater 752*a* disposed inside the heating plate body. An insulating portion 752*b* for insulating the heating plate body 752 may be disposed on the bottom surface of the heat supply body 751.

The heating plate heater 752*a* receives power via a second power line 759. That is, the second power line 759 includes an electric wire for connecting the first connecting terminal 754*a* with one end of the heating plate heater 752*a*, and an electric wire for connecting the second connecting terminal 754*b* with the other end of the heating plate heater 752*a*. Accordingly, in a state in which the terminals 715*a* and 715*b* are respectively connected to the connecting terminals 754*a* and 754*b* (in a state in which the steam supply body is coupled to the heat supply body), when the heating plate power controller 717 closes a power circuit, the heating plate heater 752*a* will generate heat.

The heating plate 752 has a steam discharge hole 752*c* defined to extend through the heating plate body. The steam discharge hole 752*c* may be connected to the communication hole 754*c* via the second flow path 758. Therefore, when the steam supply body 711 is connected to the heat supply body 751, steam discharged from the first flow path 713 may move to the steam discharge hole 752*c* via the communication hole 754*c* and the second flow path 758.

In one example, when the steam discharge hole 752*c* includes a plurality of holes, the heat supply body 751 may further include a nozzle 753. The nozzle 753 is preferably disposed to supply the steam supplied from the second flow path 758 to each steam discharge hole 752*c*.

As shown in FIG. 12, in order to minimize a risk of damage to the laundry by the heating plate 752, the heat supply 75 may further include a heating plate separating portion 77. As shown in FIG. 13, the heating plate separating portion 77 may include withdrawable bodies 771 and 773 that may be respectively withdrawn through heating plate through-holes 752*d* and 752*e* defined in the heating plate, and actuators 772 and 774 for respectively adjusting positions of the withdrawable bodies. The actuators 772 and 774 are means for generating power for causing free ends of the withdrawing bodies 771 and 773 to reciprocate between first points located inside the heating plate through-holes 752*d* and 752*e* and second points located outside the heating plate through-holes 752*d* and 752*e*.

The heating plate through-holes 752*d* and 752*e* may be defined as a first through-hole 752*d* and a second through-hole 752*e* defined to extend through the heating plate body. The first through-hole 752*d* and the second through-hole 752*e* may be defined at front and rear portions of the heating plate 752, respectively, or at left and right sides of the heating plate 752, respectively. The drawing illustrates a case in which the first through-hole 752*d* and the second through-hole 752*e* are defined at the front and rear portions of the heating plate 752, respectively.

The withdrawable bodies may include a first withdrawable body 771 positioned in the first through-hole 752*d*, and a second withdrawable body 773 positioned in the second through-hole 752*e*. In this case, the actuator should be constructed to include a first actuator 772 for causing the first withdrawable body 771 to reciprocate between the first point and the second point, and a second actuator 774 for causing the second withdrawable body 773 to reciprocate between the first point and the second point.

FIG. 13 shows a case in which a free end of the first withdrawable body 771 and a free end of the second withdrawable body 773 are located at the first points, and FIG. 12 shows a case in which the free end of the first withdrawable body 771 and the free end of the second withdrawable body 773 are positioned at the second points.

The actuators 772 and 774 may operate by a withdrawable body controller (not shown) disposed in the steam supply body 711. That is, when the user inputs a control command to the withdrawable body controller, the actuators 772 and 774 may adjust the positions of the withdrawable bodies 771 and 773 in response to the input control command.

Further, the actuators 772 and 774 may move the free ends of the withdrawable bodies 771 and 773 to the second points when the user does not grip the handle 712 for a reference duration (a first reference duration) or more.

That is, the steam supply body 711 may further include contact sensing means (not shown) for detecting whether a user's body and the handle 712 are in contact with each other. The actuators 772 and 774 may move the free ends of the withdrawable bodies 771 and 773 to the second points when a duration the user's body is separated from the handle 712 is equal to or longer than the first reference duration. When the contact sensing means detects that the user's body is in contact with the handle 712 or the control command is input to the withdrawable body controller, the actuators will move the free ends of the withdrawable bodies from the second points to the first points.

Contrary to the above, the actuators 772 and 774 may move the free ends of the withdrawable bodies 771 and 773 to the second points when a duration in which the treating means 7 is stationary and stopped becomes longer than a reference duration (a second reference duration).

That is, the steam supply body 711 may further include position detecting means (not shown) for detecting a movement of the heat supply body 751, and the actuators 772 and 774 may move the free ends of the withdrawable bodies 771 and 773 to the second points when a change in the position of the heat supply body 751 is not detected during the second reference duration. When the movement of the heat supply body 751 occurs, when the contact sensing means detects that the user's body is in contact with the handle 712, or when the control command is input to the withdrawable body controller, the actuators will move the free ends of the withdrawable bodies from the second points to the first points. The first reference duration and the second reference duration may be set as the same duration.

In the treating means 7 having the above structure, the steam supply body 711 having the handle 712 is fixed to the heat supply body 751 so as not to be pivotable. Therefore, the user must use a wrist a lot when ironing the laundry seated on the support body 31.

In order to solve the above-mentioned shortcoming, as shown in FIG. 13, the connecting body 754 may include a first connecting body 755 fixed to the heat supply body 751 so as to be pivotable via a connecting body first shaft 755*a*, a connecting body first through-hole 755*b* defined to extend through the first connecting body 755, and a second connecting body 756 fixed to the first connecting body 755 so as to be pivotable via a connecting body second shaft 756*a* and located inside the connecting body first through-hole 755*b*.

In this case, the communication hole 754*c* to which one end of the second flow path 758 is fixed must extend through the second connecting body 756. In addition, the first connecting terminal 754*a*, the second connecting terminal 754*b*, and the fixing protrusion 757*a* of the fastening body should also be disposed in the second connecting body 756.

An angle between the connecting body first shaft 755*a* and the connecting body second shaft 756*b* may be in a range from 0 degrees to 90 degrees. FIG. 13 illustrates a case in which the connecting body first shaft 755*a* and the connecting body second shaft 756*b* are orthogonal to each other as an example.

When an intersection angle of the connecting body first shaft 755*a* and the connecting body second shaft 756*b* is set to 90 degrees, the handle 712 may not only be pivotable in a left and right direction of the heat supply body 751 via the connecting body first shaft 755*a*, but also be pivotable along a front and rear direction of the heat supply body 751 via the connecting body second shaft 756*a*. Therefore, the treating means 7 according to the present embodiment will be able to minimize a burden on the user's wrist.

Figure 15:
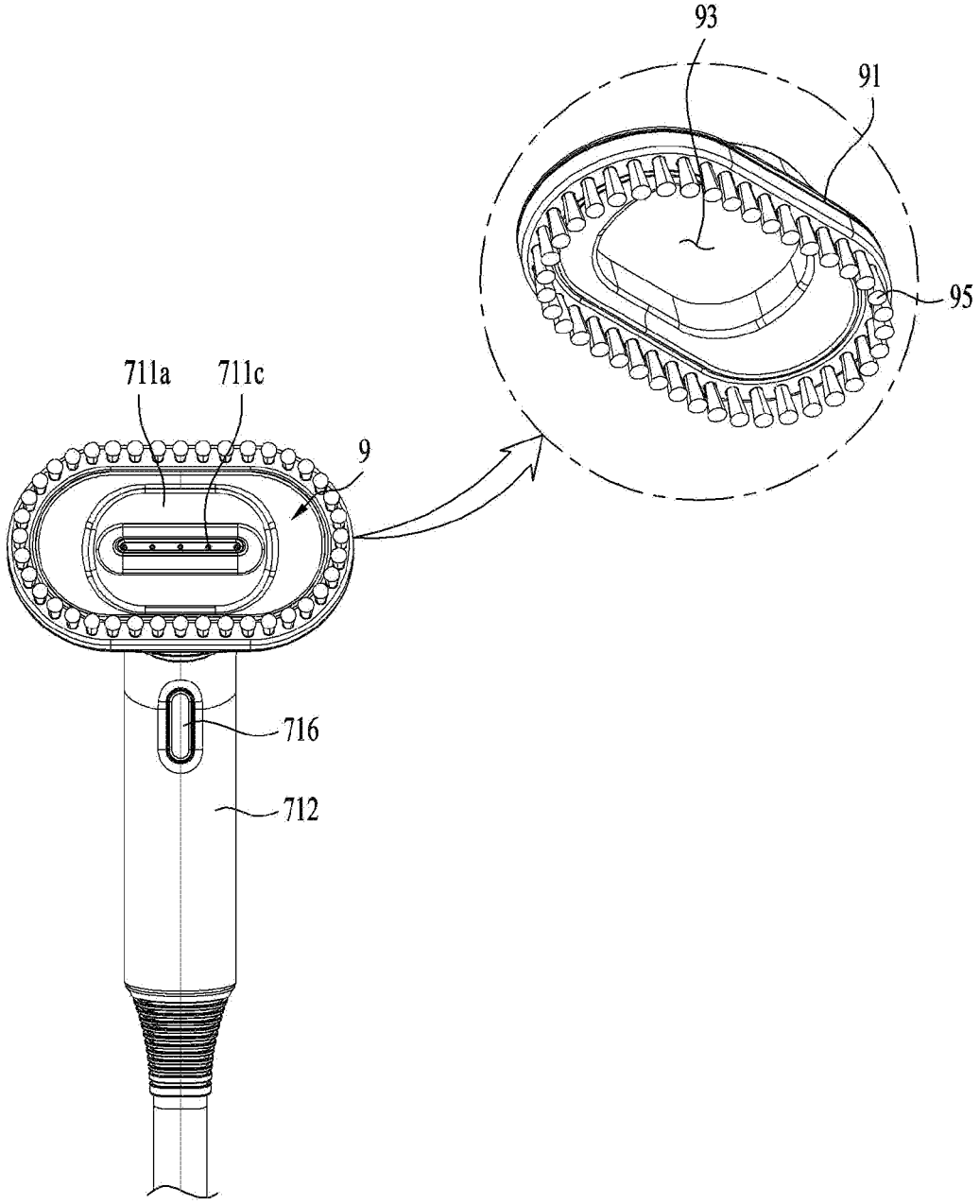
FIGS. 15 and 16 show an example of treating means and a brushing unit.

As shown in FIG. 15, the treating means 9 may further include a brushing unit 9 for separating foreign substances remaining on the laundry from the laundry.

The brushing unit 9 may be detachably fixed to the contact surface 712*b* of the steam supply body 711. FIG. 15 illustrates a case in which the brushing unit 9 is fixed to a brushing unit mounting portion 711*a* disposed on the contact surface 712*b* as an example. In this case, the brushing unit mounting portion 711*a* should have a flow path connecting hole 711*c* connecting the first flow path 713 and the communication hole 754*c* to each other.

The brushing unit 9 may include a unit body 91, a unit body through-hole 93 defined to extend through the unit body 91 and into which the brushing unit mounting portion 711*a* is inserted, and a brush 95 protruding from the unit body 91. Accordingly, the user may fix or detach the brushing unit 9 to or from the brushing unit mounting portion 711*a* as needed.

Figure 16:
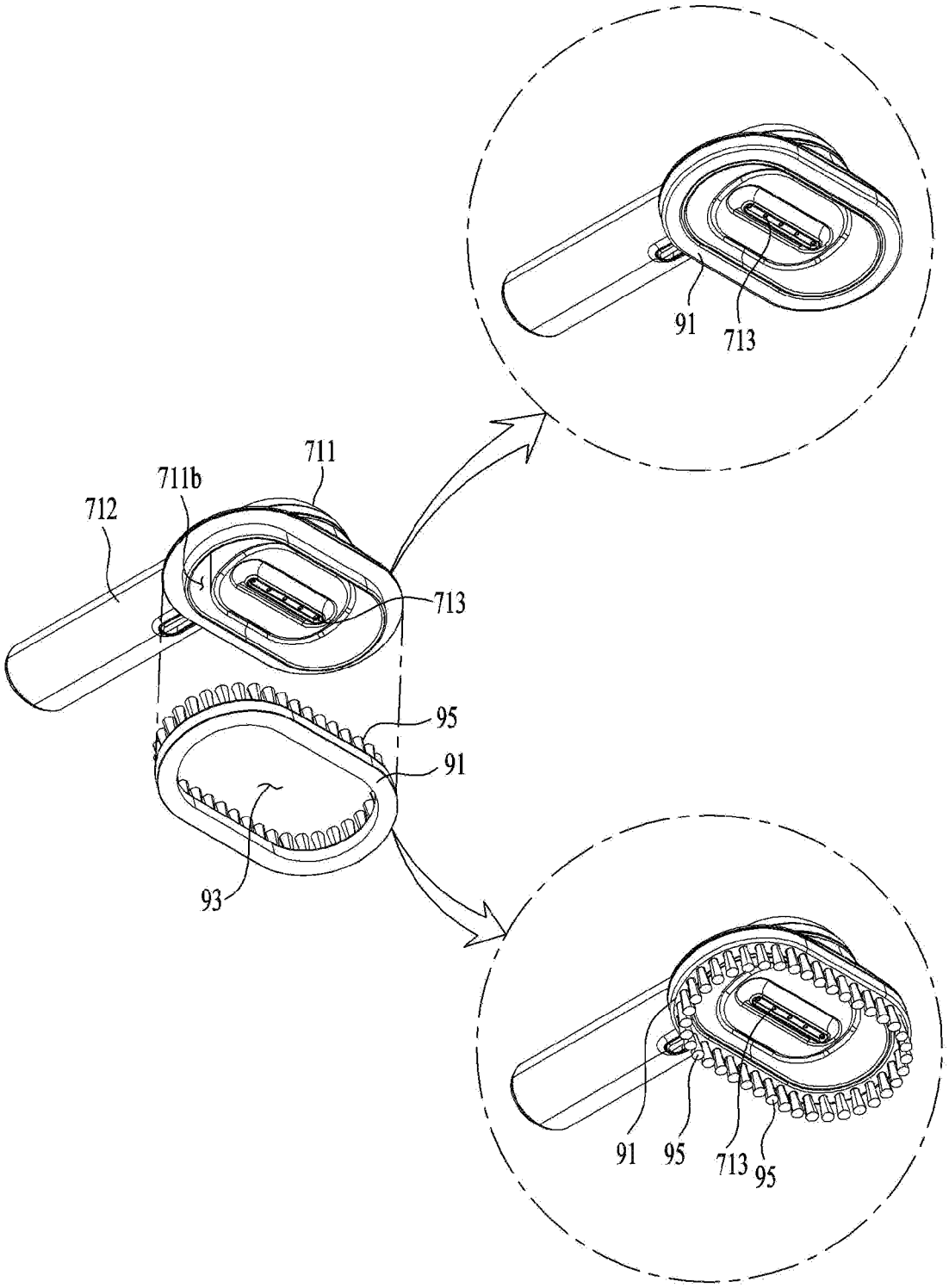

An embodiment shown in FIG. 16 is characterized in that the steam supply body 711 has a space in which the brushing unit 9 is accommodated. That is, the steam supply body 711 according to the present embodiment has a brushing unit accommodating groove 711*b* defined as a groove in which the contact surface 712*b* is concavely bent so as to provide a space in which the unit body 91 and the brush 95 are accommodated.

The brushing unit accommodating groove 711*b* may be defined in the same shape as that of the unit body 91. FIG. 16 illustrates a case in which the brushing unit accommodating groove 711*b* is defined in a ring shape surrounding the brushing unit mounting portion 711*a*.

Figure 17:
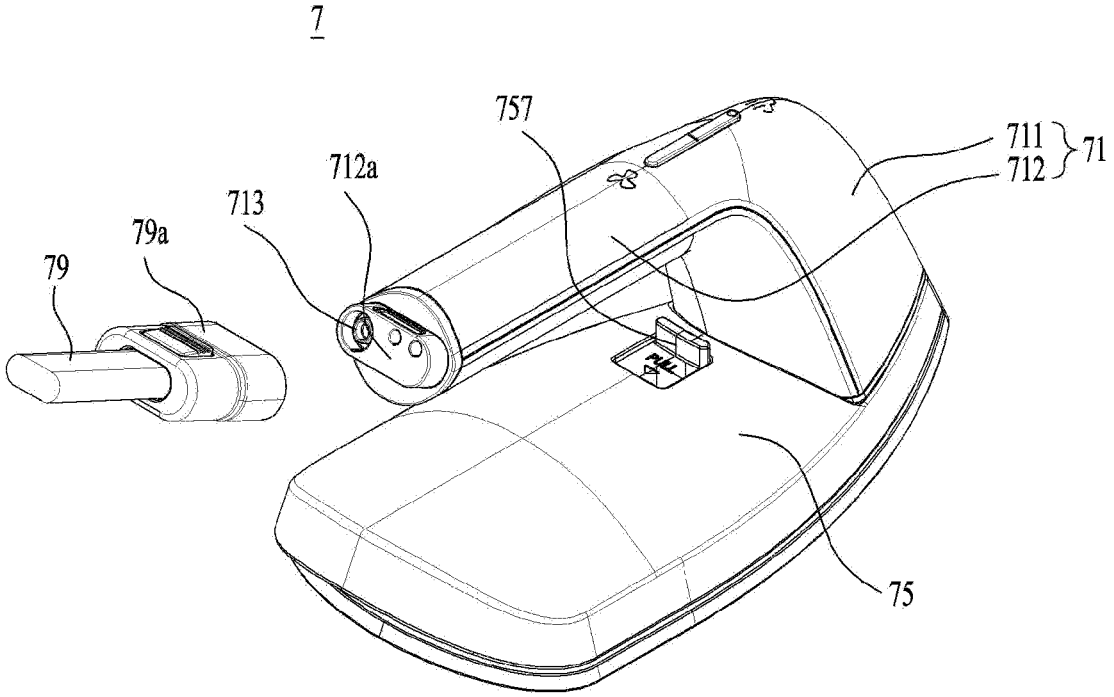
FIGS. 17 and 18 show another embodiment of treating means.
Figure 18:
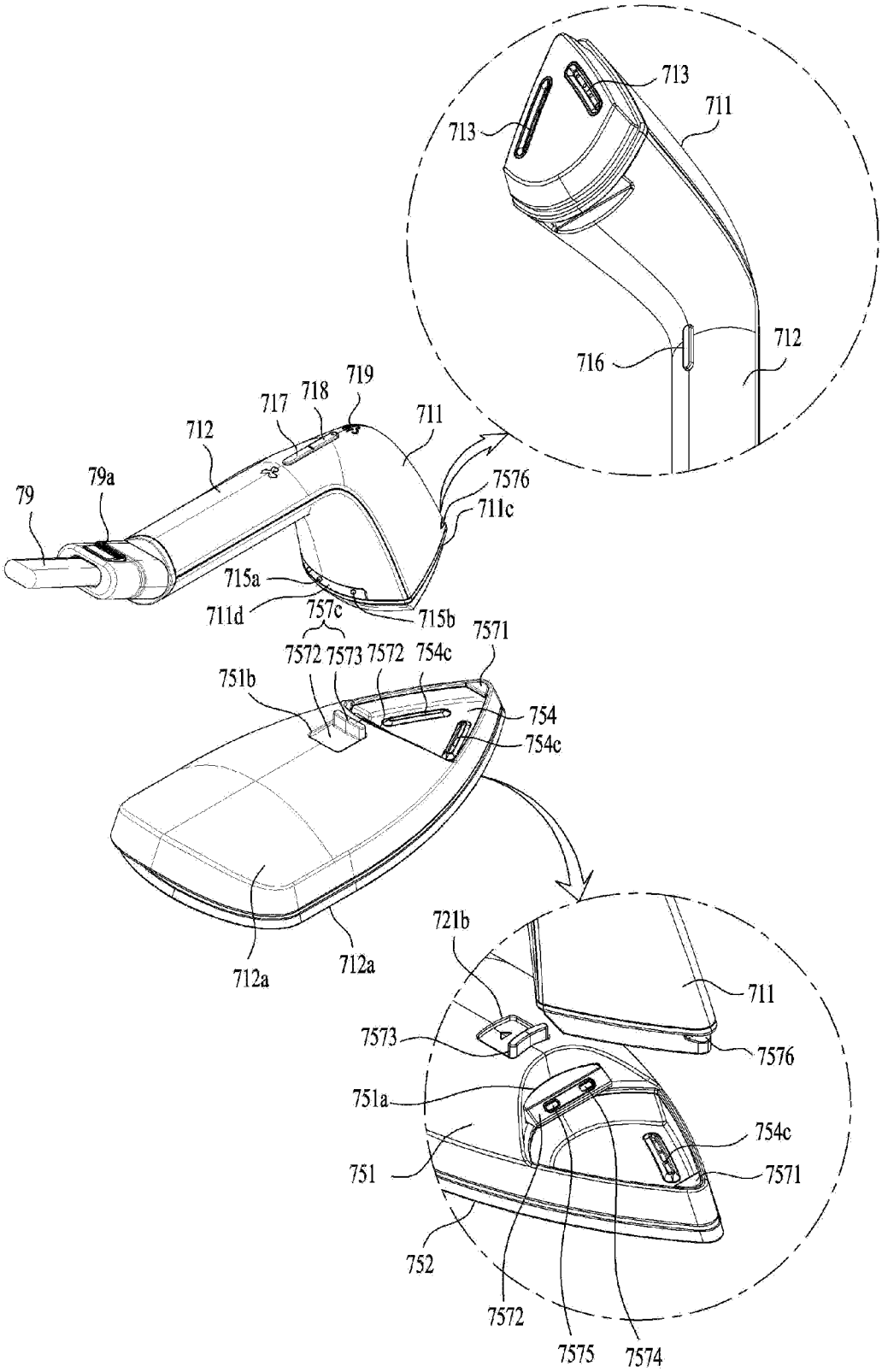

FIGS. 17 and 18 show another embodiment of the treating means 7. The treating means 7 according to the present embodiment may have the same structure as the treating means 7 shown in FIG. 13 except for a structure of the fastening body 757 connecting the steam supply body 711 and the heat supply body 751 to each other.

As shown in FIG. 18, the treating means 7 according to the present embodiment includes a steam supply 71 and a heat supply 75.

The steam supply 71 includes a steam supply body 711 having a handle 712. One end of the steam supply body 711 may have a connector second fixing portion 712*a* to which a first fastening end 79*a* of a connector is fixed, and the other end (a surface having a contact surface) of the steam supply body 711 may have a discharge port (a first flow path discharge port) of the first flow path 713. One end of the first flow path 713 is exposed to the connector second fixing portion 712*a*, and the other end thereof is connected to the first flow path discharge port.

The steam supply body 711 may include a valve controller 716 for controlling the flow path valve 714, a power controller 717 for controlling opening and closing of a first power line 715, a fan controller 718 for controlling the fan 312 of the support, and a display 719. Functions and structures of the valve controller, the power controller, the fan controller, and the display are the same as those of the above-described embodiment, so that detailed descriptions thereof will be omitted.

The heat supply 75 may include a heat supply body 751 having a bottom surface to which a heating plate 752 is fixed, and connecting portions 754 and 757 formed on a top surface of the heat supply body. A structure of the heating plate may be the same as that in the above-described embodiment.

The connecting portion may include a connecting body 754 fixed to the heat supply body 751, and a fastening body 757 for coupling the connecting body and the steam supply body 711 to each other.

A second power line 759 for supplying power to the heating plate heater 752*a*, and a second flow path 758 for supplying steam to the steam discharge hole 752*c* are disposed inside the heat supply body 751. The second flow path 758 is connected to the first flow path 713 via a communication hole 754*c* defined in the connecting body 754.

The fastening body 757 in the present embodiment may include a first lock body 7571 disposed on the connecting body 754, a second lock body 7572 that may be withdrawn from an interior of the heat supply body 751 to the connecting body 754, a lock handle 7573 exposed on one surface of the heat supply body 751, a first groove 7576 defined in the steam supply body 711 and into which the first lock body is inserted, and a second groove 7577 defined in the steam supply body 711 and into which the second lock body is inserted.

The heat supply body 751 should provide a space in which the second lock body 7572 is accommodated and should have a guide (not shown) providing a movement path of the second lock body. The heat supply body 751 or the connecting body 754 may have a lock body outlet 751*a* in communication with the guide, and the top surface of the heat supply body 751 may have a supply body through-hole 751*b* in communication with the guide.

In this case, one end of the second lock body 7572 may be located inside the guide, and a free end of the second lock body 7572 may be exposed to the outside of the guide via the lock body outlet 751*a*.

The lock handle 7573 is means fixed to the second lock body 7572 to allow the user to move the second lock body 7572. The lock handle 7573 may be exposed to the outside of the heat supply body 751 via the supply body through-hole 751*b*, and the supply body through-hole 751*b* may be defined as a slit providing a movement path of the lock handle 7573.

The second lock body 7572 has a first connecting terminal 7574 and a second connecting terminal 7575 connected to the second power line 759, and a first terminal 715*a* and a second terminal 715*b* are disposed inside the second groove 7577. When a free end of the second lock body 7572 is inserted into the second groove 7577, the first connecting terminal 7574 and the second connecting terminal 7575 are connected to the first terminal 715*a* and the second terminal 715*b*, respectively.

Because the components constituting the above-described laundry treating apparatus may be changed into various structures as long as they implement the same function, the scope of the present disclosure is not limited to the above-described embodiment.

The invention claimed is:

1. A laundry treating apparatus comprising:

a cabinet defining a first housing and a second housing;

an outlet extending through a top surface of the cabinet and being in fluid communication with the second housing;

a first support configured to rotate toward the top surface of the cabinet relative to the cabinet, the first support configured to support laundry;

a laundry treating tool configured to be received at and retrieved from the first housing, the laundry treating tool being configured to supply at least one of heat or moisture to the laundry;

a body configured to be received at and retrieved from the second housing via the outlet; and a second support disposed at the body and configured to be positioned above the first support based on the body being retrieved from the second housing, the second support being configured to support the laundry and having an area smaller than an area of the first support, wherein the second support includes:

a first board coupled to the body and configured to rotate relative to the body toward a top surface of the first support, and a second board coupled to the first board and configured to rotate in a plane parallel to the top surface of the first support, the second board being configured to support the laundry, and wherein the second support is coupled to the body and configured to move between a first position below the first support and a second position above the first support based on movement of the body via the outlet.

2. The laundry treating apparatus of claim 1, wherein the second support is configured to be received at and retrieved from the body.

3. The laundry treating apparatus of claim 1, further comprising:

a board accommodating portion including a groove that is defined at a surface facing toward the first support, the board accommodating portion being configured to accommodate the second support.

4. The laundry treating apparatus of claim 3, further comprising:

a clothes hanger support configured to be retrieved from the body and configured to support a hook of a clothes hanger.

5. The laundry treating apparatus of claim 4, wherein the clothes hanger support includes:

a support bar configured to be retrieved from the body; and a hook accommodating portion including a groove that is defined at a surface of the support bar or a protrusion protruding from the surface of the support bar, the hook accommodating portion being configured to accommodate the hook of the clothes hanger.

6. The laundry treating apparatus of claim 3, further comprising:

a steam generator including a storage configured to store water therein, and a heater configured to heat water inside the storage, wherein the steam generator is disposed at the first housing;

a flow path fastening portion disposed at the body;

a connecting tube that connects the flow path fastening portion to the storage; and a connector having a first end connected to the laundry treating tool and a second end detachably connected to the flow path fastening portion to supply steam to the laundry treating tool.

7. The laundry treating apparatus of claim 6, wherein the laundry treating tool includes:

a heat supply body having a heating plate positioned at a bottom surface of the heat supply body, the heat supply body being configured to dissipate heat resulting from power being supplied;

a handle fixed to the heat supply body;

a connecting portion configured to detachably connect the handle to the heat supply body;

a first flow path defined at the handle and configured to provide a flow path that permits steam supplied via the connector to move; and a second flow path that connects a communication hole to a steam discharge hole, the communication hole extending through the connecting portion, and the steam discharge hole extending through the heating plate, wherein the second flow path is connected to the first flow path via the communication hole.

8. The laundry treating apparatus of claim 7, further comprising:

a cabinet power line disposed at the cabinet and connected to a power supply;

a power line fastening portion disposed at the body and connected to the power supply;

a power line connecting portion disposed at the connector and detachably coupled to the power line fastening portion;

a first power line configured to supply power supplied to the power line connecting portion to a first terminal and a second terminal disposed at one end of the handle;

a first connecting terminal and a second connecting terminal provided at the connecting portion and contacting the first terminal and the second terminal, respectively, based on the handle fixed to the heat supply body; and a second power line configured to supply power supplied to the first connecting terminal and the second connecting terminal to the heating plate.

9. The laundry treating apparatus of claim 8, further comprising:

a connector fixing portion provided at the body and configured to detachably fix one end of the connector, wherein the power line fastening portion and the flow path fastening portion are disposed at the connector fixing portion.

10. The laundry treating apparatus of claim 8, further comprising:

a power controller disposed at the body and configured to control opening and closing of a circuit to selectively connect the heater and the cabinet power line to each other.

11. The laundry treating apparatus of claim 8, further comprising:

a water level detector configured to detect a water level inside the storage; and a display positioned at the body and configured to display information transmitted from the water level detector.

12. The laundry treating apparatus of claim 8, further comprising:

a lamp disposed at the body and configured to emit light to the first support; and a lamp controller disposed at the body and configured to control operation of the lamp.

13. The laundry treating apparatus of claim 8, further comprising:

a flow path valve configured to open and close the first flow path; and a valve controller disposed at the handle and configured to operate the flow path valve.

14. The laundry treating apparatus of claim 8, further comprising:

a heating plate power controller disposed at the handle and configured to control opening and closing of the first power line.

15. The laundry treating apparatus of claim 8, further comprising:

a water level detector configured to detect a water level inside the storage; and a handle display disposed at the handle and configured to display information detected by the water level detector.

16. The laundry treating apparatus of claim 8, further comprising:

a first through-hole defined at a surface of the first support that is configured to support the laundry;

a second through-hole defined at the first support;

a fan configured to move air from the first through-hole to the second through-hole; and a fan controller disposed at the handle and configured to control operation of the fan.

17. The laundry treating apparatus of claim 8, further comprising:

a first through-hole defined at a surface of the first support that is configured to support the laundry;

a second through-hole defined at the first support;

a fan configured to move air from the first through-hole to the second through-hole; and a fan controller disposed at the handle and configured to control a number of rotations of the fan.

18. The laundry treating apparatus of claim 1, wherein the body is configured to move vertically in and out from the second housing via the outlet.

19. A laundry treating apparatus comprising:

a cabinet defining a first housing and a second housing;

an outlet extending through a top surface of the cabinet and being in fluid communication with the second housing;

a first support configured to rotate toward the top surface of the cabinet relative to the cabinet, the first support being configured to support laundry;

a body configured to be received at and retrieved from the second housing via the outlet;

a second support disposed at the body and configured to be positioned above the first support, the second support being configured to support the laundry and having an area smaller than an area of the first support; and a board accommodating portion including a groove that is defined at a surface facing toward the first support, the board accommodating portion being configured to accommodate the second support, wherein the second support includes:

a first board coupled to the body and configured to rotate relative to the body toward a top surface of the first support, and a second board coupled to the first board and configured to rotate in a plane parallel to the top surface of the first support, the second board being configured to support the laundry.

20. The laundry treating apparatus of claim 19, wherein the second support is configured to be received at and retrieved from the body.

* * * * *